US009933716B2

(12) United States Patent
Hirano et al.

(10) Patent No.: US 9,933,716 B2
(45) Date of Patent: Apr. 3, 2018

(54) TONER FOR ELECTROSTATIC CHARGE IMAGE DEVELOPMENT

(71) Applicant: Konica Minolta, Inc., Tokyo (JP)

(72) Inventors: Shiro Hirano, Hachioji (JP); Noboru Ueda, Mitaka (JP); Kouji Sugama, Musashino (JP); Junya Onishi, Hachioji (JP); Aya Shirai, Hino (JP); Tatsuya Fujisaki, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/278,687

(22) Filed: Sep. 28, 2016

(65) Prior Publication Data

US 2017/0205722 A1 Jul. 20, 2017

(30) Foreign Application Priority Data

Jan. 15, 2016 (JP) ..... 2016-006376

(51) Int. Cl.

| | |
|---|---|
| ***G03G 9/08*** | (2006.01) |
| ***G03G 9/087*** | (2006.01) |
| ***G03G 9/097*** | (2006.01) |
| ***G03G 9/09*** | (2006.01) |
| ***G03G 9/093*** | (2006.01) |

(52) U.S. Cl.

CPC ..... *G03G 9/08711* (2013.01); *G03G 9/0825* (2013.01); *G03G 9/08722* (2013.01); *G03G 9/08755* (2013.01); *G03G 9/0904* (2013.01); *G03G 9/0926* (2013.01); *G03G 9/09321* (2013.01); *G03G 9/09364* (2013.01); *G03G 9/09392* (2013.01); *G03G 9/09708* (2013.01)

(58) Field of Classification Search

CPC ..... G03G 9/09708; G03G 9/08722

USPC ..... 430/108.3

See application file for complete search history.

(56) References Cited

U.S. PATENT DOCUMENTS

| | | | | |
|---|---|---|---|---|
| 2002/0048010 | A1 | 4/2002 | Inaba et al. | |
| 2005/0255402 | A1 | 11/2005 | Hopper et al. | |
| 2007/0224532 | A1* | 9/2007 | Vanbesien | G03G 9/09321 430/108.22 |
| 2011/0236812 | A1 | 9/2011 | Ishihara et al. | |
| 2015/0220009 | A1 | 8/2015 | Sato et al. | |

FOREIGN PATENT DOCUMENTS

| | | | |
|---|---|---|---|
| JP | H08-262788 | A | 10/1996 |
| JP | 2002108019 | A | 4/2002 |
| JP | 2005-018058 | A | 1/2005 |

(Continued)

*Primary Examiner* — Mark A Chapman

(74) *Attorney, Agent, or Firm* — Lucas & Mercanti, LLP

(57) ABSTRACT

The present invention relates to a toner for electrostatic charge image development, including toner base particles containing a binder resin containing as a main component a vinyl resin having a constitutional unit derived from a monomer having an acid group, and aluminum, wherein a concentration of the aluminum in the toner base particles, as measured by radio inductively coupled plasma emission spectral analysis, is from 900 to 2,200 ppm. According to the present invention, there is provided a means for improving the environmental stability of electrification, and the glossiness and the image density of the image to be formed in a good balance while maintaining sufficient low temperature fixability in a toner for electrostatic charge image development.

7 Claims, 1 Drawing Sheet

(56) References Cited

FOREIGN PATENT DOCUMENTS

| | | | |
|---|---|---|---|
| JP | 2008-158319 | A | 7/2008 |
| JP | 2011-145568 | A | 7/2011 |
| JP | 2011-203433 | A | 10/2011 |
| JP | 2012-168222 | A | 9/2012 |
| JP | 2015148724 | A | 8/2015 |

* cited by examiner

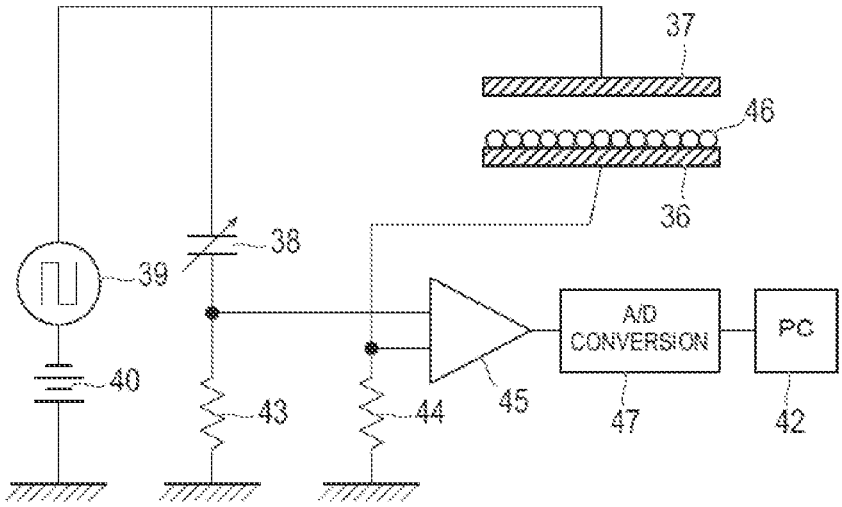
37
46
36
38
39
40
43
44
45
A/D
CONVERSION
PC
47
42

TONER FOR ELECTROSTATIC CHARGE IMAGE DEVELOPMENT

CROSS-REFERENCE TO RELATED APPLICATION

This application is based on Japanese Patent Application No. 2016-006376 filed on Jan. 15, 2016, the contents of which are incorporated herein by reference.

BACKGROUND

1. Technical Field

The present invention relates to a toner for electrostatic charge image development.

2. Description of Related Art

In recent years, a toner exhibiting excellent low temperature fixability has been demanded in order to fix a toner image with less energy than in the prior art from the viewpoint of an increase in speed and energy saving. It is required to lower the melting temperature or melt viscosity of the binder resin which constitutes the toner in order to lower the fixing temperature of the toner.

Moreover, it has been demanded a technique which can improve not only the low temperature fixability but also other properties in association with the request for the diversification or image quality enhancement of printed matters in recent years.

For example, a toner having toner particles which contain a polyester resin as a main component and further contain styrene-(meth)acrylic resin particles and a trace amount of aluminum element has been proposed in JP 2015-148724 A (corresponding to US 2015/220,009 A1) as a technique related to the image quality enhancement of fixed image which has been demanded more and more in recent years. The polyester resin exhibits excellent sharp meltability and has an advantage that the softening point can be easily lowered while maintaining a higher glass transition temperature (Tg) as compared to a styrene-acrylic resin. Moreover, according to the toner, it is possible to suppress the gloss unevenness of a halftone image while maintaining low temperature fixability.

In addition, a toner having toner particles which contain a specific amount of a specific element such as magnesium or calcium together with a sulfur element-containing polymer has been proposed in JP 2002-108019 A (corresponding to US 2002/048,010 A1). According to the toner, uniformity or environmental stability of electrification of the halftone image is improved.

SUMMARY

As described above, the kinds of media (the substrate to be printed on) are also diversified in association with the diversification of printed matters in recent years. In addition, the level required not only for favorable low temperature fixability but also for the request related to the image quality enhancement has been increased more and more.

Hence, a high-performance toner which can correspond to various media without degrading the low temperature fixability is demanded. More specifically, a technique which can decrease the environmental dependency of the electric charge amount without impairing the low temperature fixability and can exert excellent glossiness or image density on various media is demanded.

However, there is a problem in the technique according to JP 2015-148724 A (corresponding to US 2015/220,009 A1) that the toner particles are easily to absorb moisture and the environmental dependency of the electric charge amount increases (namely, the environmental stability of electrification decreases). In addition, it is difficult to form an image having excellent glossiness or image density by the toner disclosed in this literature.

In addition, it is difficult to improve the glossiness and the image density of the image to be formed in a good balance while maintaining the low temperature fixability even by the toner disclosed in JP 2002-108019 A (corresponding to US 2002/048,010 A1).

Accordingly, an object of the present invention is to provide a means for improving the environmental stability of electrification, and the glossiness and the image density of the image to be formed in a good balance while maintaining sufficiently low temperature fixability in a toner for electrostatic charge image development.

In order to achieve at least one of the above objects, the toner for electrostatic charge image development that reflects one aspect of the present invention is a toner for electrostatic charge image development which contains toner base particles containing a binder resin containing as a main component a vinyl resin having a constitutional unit derived from a monomer having an acid group, and aluminum, and in which a concentration of the aluminum in the toner base particles, as measured by radio inductively coupled plasma emission spectral analysis, is from 900 to 2,200 ppm.

BRIEF DESCRIPTION OF THE DRAWINGS

FIGURE is a schematic diagram illustrating the outline of an apparatus to measure the electric charge amount of the toner. In FIGURE, the reference numerals 36 and 37 represent a parallel plate electrode; the reference numeral 38 represents a variable capacity condenser; the reference numerals 39 and 40 represent a power source; the reference numeral 42 represents a personal computer (PC); the reference numerals 43 and 44 represent a resistor; the reference numeral 45 represents a buffer; the reference numeral 46 represents a two-component developer (namely, toner and carrier); and the reference numeral 47 represents an A/D conversion, respectively.

DETAILED DESCRIPTION

Hereinafter, embodiments of the present invention will be described. Incidentally, the present invention is not limited to the following embodiments. In addition, in the present specification, the term "X to Y" to indicate the range includes X and Y and means "X or more and Y or less". In addition, the operations and the measurement of physical properties and the like are conducted under a condition of room temperature (20 to 25° C.) relative humidity of from 40 to 50% RH unless otherwise stated.

The toner for electrostatic charge image development according to the present invention satisfies the following requirements (1) and (2);

(1) the toner base particles contain a binder resin containing as a main component a vinyl resin having a constitutional unit derived from a monomer having an acid group; and (2) a concentration of the aluminum in the toner base particles, as measured by radio inductively coupled plasma emission spectral analysis (ICP emission spectral analysis), is from 900 to 2,200 ppm.

In the toner for electrostatic charge image development according to the present invention, the toner base particles contain a vinyl resin as a main component and the concentration of aluminum contained in the toner base particles is within a predetermined range. By having such a configuration, a means for improving the environmental stability of electrification, and the glossiness and the image density of the image to be formed in a good balance while maintaining sufficient low temperature fixability in the toner for electrostatic charge image development is provided.

Incidentally, in the present specification, the term "toner for electrostatic charge image development" may sometimes be referred to simply as "toner". In addition, in the present specification, the term "ppm" is based on mass and represents the term "ppm by mass" unless otherwise stated.

In the toner according to the present invention, the environmental dependency of the electric charge amount decreases, and the glossiness and the image density of the image to be formed can be improved while favorable low temperature fixability is maintained by satisfying the requirements (1) and (2) described above. The action mechanism through which the effect described above is obtained from the toner of the present invention is unclear, but it is considered as follows.

The toner according to the present invention satisfies the requirement (2) described above. That is, the toner base particles contain aluminum at a specific concentration. The aluminum is presumed to be present in the form of an ion in the toner base particles, and is considered to form a crosslinked structure (network) with the acid group in the binder resin. Moreover, the elasticity of the binder resin moderately increases as the aluminum (ion) to form such a crosslinked structure is contained at a concentration of 900 ppm or more, and thus it is suppressed that the toner penetrates into the concave and convex (into the fiber) of the rough paper. As a result, it is considered that the improvement of density of the image formed by using the toner is achieved. On the other hand, in a case in which the concentration of the aluminum ion is less than 900 ppm, the crosslinked structure as described above is not sufficiently formed, the elasticity of the binder resin decreases (to be in a highly fluid state), and thus the toner penetrates into the concave and convex of the rough paper and a sufficient image density is not obtained. A toner in which a fluorescent X-ray NET intensity of aluminum is 0.1 or more and 0.3 or less is disclosed in JP 2015-148724 A (corresponding to US 2015/220,009 A1), and the concentration of aluminum contained is about from 20 to 51 ppm when it is converted by ICP emission spectral analysis. Consequently, it is presumed that a sufficient image density as in the present invention is not obtained since the concentration of aluminum contained in the toner disclosed in this literature is significantly low.

In addition, as described above, it is presumed that controlling the concentration of aluminum (ion) contained in 900 ppm or more and imparting moderate elasticity to the binder resin contributes to the improvement of the glossiness of the image to be formed. The binder resin constituting the toner particles is required to exhibit a certain degree of elasticity (cohesive force) when the toner is fixed onto media (substrate) such as paper by using a fixing member (fixing roller or the like). At this time, the elasticity of the toner particles is moderately improved by the crosslinked structure in the toner of the present invention, and thus the toner particles hardly adhere to the fixing member. Hence, the disruption (namely, hot offset phenomenon) of the toner layer caused by the adhesion of the toner particles to the fixing member can be suppressed. As a result, it is considered that the glossiness of the image to be formed even on coated paper is improved. On the other hand, in a case in which the concentration of the aluminum ion is less than 900 ppm, the crosslinked structure as described above is not sufficiently formed, the hot offset phenomenon is likely to occur, and the glossiness of the image to be formed is impaired.

Here, as presented in the following Examples, the effect of improving the image density or glossiness as describe above is not obtained by the toner base particles which contain an element such as magnesium or calcium and are disclosed in JP 2002-108019 A (corresponding to US 2002/048,010 A1), for example. It is presumed that this is because magnesium and calcium can be present in the toner base particles as a divalent metal ion and thus sufficient crosslinked structures cannot be formed as compared to a trivalent aluminum ion and the elasticity of the binder resin cannot be moderately controlled.

In addition, it is possible to suppress the excessive progress of crosslinking by the aluminum ion by controlling the concentration of aluminum contained to 2,200 ppm or less, and thus the elasticity of the binder resin does not increase too high but moderate elasticity can be maintained. As a result, it is presumed that the low temperature fixability of the toner is favorably maintained. On the other hand, in a case in which the concentration of aluminum contained in the toner base particles exceeds 2,200 ppm, although the effect of improving the image density or glossiness as describe above is obtained, the content of ionic substance increases, and thus the toner particles are highly polarized to exhibit high hygroscopic property. As a result, it is considered that the toner particles are unlikely to be charged and the environmental stability of electric charge amount is impaired.

In addition, the toner according to the present invention satisfies the requirement (1) described above. That is, the binder resin contains a vinyl resin as a main component. The water molecule is likely to adsorb to the binder resin by the hydrogen bonding of the ester moiety when the binder resin contains a polyester resin as a main component, and as a result, the hygroscopic property of the binder resin increase so as to be hardly electrified. Consequently, the electrification property decrease particularly in a high-temperature and high-humidity environment. In contrast, a decrease in electrification property caused by the hygroscopic property of the polyester resin as described above is suppressed by containing a vinyl resin as a main component, and thus it is possible to improve the environmental stability of electrification. In addition, there is also an advantage that the manufacturing cost is cut down by containing a vinyl resin as a main component instead of a polyester resin.

Incidentally, the mechanism described above is a presumption, and the present invention is not limited to the mechanism described above.

Hereinafter, the toner for electrostatic charge image development of the present invention will be described in detail. Incidentally, the toner according to the present invention contains the "toner base particles" as described above. The "toner base particles" are referred to as the "toner particles" after the addition of an external additive. Moreover, the "toner" refers to an aggregate of the "toner particles".

[Toner Base Particles]

The "toner base particles" are those which constitute the base of the toner particles to be used in the electrophotographic image formation. The toner base particles according to the present invention contain a binder resin containing a vinyl resin as a main component, and aluminum. In addition, the toner base particles may contain other components such as a colorant, a release agent, and a charge control agent if necessary.

<Binder Resin>

The binder resin contained in the toner base particles according to the present invention contains as a main component a vinyl resin having a constitutional unit derived from a monomer having an acid group.

<<Vinyl Resin>>

One of the features of the toner of the present invention is that the vinyl resin is the main component of the binder resin contained in the toner. Here, the phrase "the vinyl resin is the main component" means that the content ratio of the vinyl resin (the content ratio of the sum in a case in which two or more kinds of vinyl resins are contained) exceeds 50% by mass relative to the total amount of the binder resin contained in the toner base particles. As the vinyl resin is the main component, the hygroscopic property of the toner particles decrease as compared to a case in which a polyester resin is the main component, for example, as the toner disclosed in JP 2015-148724 A (corresponding to US 2015/220,009 A1). As a result, it is possible to decrease the environmental dependency of the electric charge amount.

The binder resin contains the vinyl resin as the main component, and may contain other resin components other than the vinyl resin. Incidentally, the other resin components will be described in detail later.

The content ratio of the vinyl resin is preferably 60% by mass or more, more preferably 70% by mass or more, even more preferably 80% by mass or more, and even more preferably 90% by mass or more relative to the total amount of the binder resin in the toner. The effect of improving the environmental stability of electrification tends to increases as the content ratio of the vinyl resin increases. On the other hand, the upper limit of the content ratio is not particularly limited, and it is 100% by mass.

The vinyl resin to be used in the present invention has a constitutional unit derived from a monomer having an acid group. Here, the term "constitutional unit" refers to a unit of a molecular structure derived from a monomer in the resin. In addition, the term "acid group" refers to a functional group which can form a corresponding functional group having a negative charge by releasing the hydrogen ion into water (for example, —COOH or —$SI_3H$), a functional group having the corresponding negative charge (for example, —$COO^-$ or —$SO_3^-$), and a functional group of which the negative charge is electrically neutralized by a counter cation (for example, —$COO^-Na^+$ or —$SO_3^-Na^+$). Incidentally, the "functional group which can form a corresponding functional group having a negative charge by releasing the hydrogen ion into water", the "functional group having the corresponding negative charge", and the "functional group of which the negative charge is electrically neutralized by a counter cation" are easily converted to one another depending on the state of the surrounding of each functional group such as pH.

The vinyl resin is likely to form a crosslinked structure with the aluminum ion contained in the toner base particles as the vinyl resin has a constitutional unit derived from a monomer having such an acid group.

Preferred examples of the "acid group" may include a carboxylic acid group, a sulfonic acid group, a sulfate monoester group, a phosphoric acid group, a phosphate monoester group, and a boric acid group. Among them, a carboxylic acid group and a sulfonic acid group are more preferable and a carboxylic acid group is even more preferable from the viewpoint of easily forming a crosslinked structure with an aluminum ion and easily improving the density or glossiness of the image to be formed. The vinyl resin having a sulfonic acid group of a strong acid has a possibility that the hygroscopic property thereof increase in light of the acidity of sulfonic acid group. Consequently, as the acid group, a carboxylic acid group is even more preferable as compared to a sulfonic acid group from the viewpoint of improving the environmental stability of electrification.

The vinyl resin having a constitutional unit derived from a monomer having an acid group is a resin obtained by polymerizing at least a vinyl monomer having the acid group. The vinyl resin may be those obtained by further using another vinyl monomer (without having the acid group) in addition to the vinyl monomer having the acid group. At this time, the content of the monomer having an acid group is preferably from 1 to 25% by mass, more preferably from 3 to 20% by mass, and even more preferably from 5 to 15% by mass relative to the total amount of the monomers constituting the vinyl resin. That is, the content of the constitutional unit derived from a monomer having an acid group is preferably from 1 to 25% by mass, more preferably from 3 to 20% by mass, and even more preferably from 5 to 15% by mass relative to the total constitutional units of the vinyl resin. By setting the content ratio of the vinyl monomer having an acid group within the range described above, it is possible not only to moderately form a crosslinked structure of the acid group with an aluminum ion but also to suppress a decrease in the environmental stability of electrification due to moisture absorption by the acid group. Incidentally, the constitutional component (constitutional unit) of the vinyl resin and the content (content ratio) of the respective constitutional components (respective constitutional units) can be determined by the NMR measurement and the methylation reaction Py-GC/MS measurement, for example.

The vinyl resin is preferably a resin formed by using a vinyl monomer having a carboxylic acid group and/or a vinyl monomer having a sulfonic acid group, and another vinyl monomer (not having an acid group) from the viewpoint of easily improving the effect of the present invention.

(Vinyl Monomer having Carboxylic Acid Group)

Examples of the vinyl monomer having a carboxylic acid group may include (meth)acrylic acid, maleic acid, itaconic acid, cinnamic acid, fumaric acid, maleic acid monoalkyl ester, and itaconic acid monoalkyl ester. Among them, it is preferable to use (meth)acrylic acid from the viewpoint of easily forming a crosslinked structure with an aluminum ion and easily improving the density or glossiness of the image to be formed. Incidentally, in the present specification, the term "(meth)acrylic acid" includes both acrylic acid and methacrylic acid.

(Vinyl Monomer having Sulfonic Acid Group)

Examples of the vinyl monomer having a sulfonic acid group may include styrenesulfonic acid, allyl sulfosuccinic acid, and 2-acrylamido-2-methylpropane sulfonic acid. Among them, it is preferable to use a styrenesulfonic acid from the viewpoint of easily forming a crosslinked structure with an aluminum ion and easily improving the density or glossiness of the image to be formed.

As the vinyl monomer having a carboxylic acid group or sulfonic acid group, one kind or more kinds selected from those described above may be used.

(Another Vinyl Monomer)

One kind or more kinds selected from the following monomers can be used in the formation of the vinyl resin in addition to the vinyl monomer having an acid group described above.

(1) Styrene Monomer (Aromatic Vinyl Monomer)

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, any derivative of these, and the like.

(2) (Meth)Acrylic Acid Ester Monomer Methyl (meth) acrylate, ethyl (meth)acrylate, n-butyl (meth)acrylate, isopropyl (meth)acrylate, isobutyl (meth)acrylate, t-butyl (meth)acrylate, n-octyl (meth) acrylate, 2-ethylhexyl (meth) acrylate, stearyl (meth)acrylate, lauryl (meth)acrylate, phenyl (meth) acrylate, diethylaminoethyl (meth) acrylate, dimethylaminoethyl (meth) acrylate, any derivative of these, and the like.

(3) Vinyl Esters

Vinyl propionate, vinyl acetate, vinyl benzoate, and the like.

(4) Vinyl Ethers

Vinyl methyl ether, vinyl ethyl ether, and the like.

(5) Vinyl Ketones

Vinyl methyl ketone, vinyl ethyl ketone, vinyl hexyl ketone, and the like.

(6) N-vinyl Compounds

N-vinylcarbazole, N-vinylindole, and N-vinylpyrrolidone, and the like.

(7) Others

Vinyl compounds such as vinylnaphthalene and vinylpyridine, acrylonitrile, methacrylonitrile, any derivative of acrylic acid or methacrylic acid such as acrylamide, and the like.

Furthermore, the vinyl resin may be changed to one that has a crosslinked structure by using a multifunctional vinyl as the vinyl monomer. Examples of the multifunctional vinyl may include divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, and neopentyl glycol diacrylate.

As "another vinyl monomer" constituting the vinyl resin, monomers described in "(1) styrene monomer (aromatic vinyl monomer) " and/or " (2) (meth) acrylic acid ester monomer" above are preferably used. That is, as the vinyl resin, an acrylic resin or a styrene-acrylic copolymer resin which is formed by (co) polymerizing a vinyl monomer having a carboxylic acid group and/or a sulfonic acid group is preferably used. The vinyl resin is preferably a styrene-acrylic copolymer resin formed by copolymerizing a vinyl monomer having a carboxylic acid group without including the constitutional unit derived from a monomer having a sulfonic acid group for the purpose of improving the environmental stability of electrification.

The styrene-acrylic copolymer resin is preferably a styrene-acrylic copolymer resin having constitutional units derived from a styrene monomer and a (meth) acrylic acid ester monomer in addition to constitutional unit derived from the vinyl monomer having a carboxylic acid group described above. Incidentally, the vinyl resin may be used singly or in combination of two or more kinds thereof.

(Method for Producing Vinyl Resin)

The method for producing the vinyl resin is not particularly limited, and examples thereof may include a method to conduct the polymerization by a known polymerization technique such as bulk polymerization, solution polymerization, emulsion polymerization, miniemulsion method, or dispersion polymerization, using an arbitrary polymerization initiator such as a peroxide, a persulfide, or an azo compound which is usually used in the polymerization of the monomer described above. In addition, a generally used chain transfer agent can be used for the purpose of adjusting the molecular weight. The chain transfer agent is not particularly limited, and examples thereof may include an alkyl mercaptan such as n-octyl mercaptan and a mercapto fatty acid ester.

The vinyl resin is preferably an amorphous resin which has a glass transition temperature (Tg) of from 25 to 60° C. and more preferably an amorphous resin which has a glass transition temperature (Tg) of from 35 to 55° C. Incidentally, the glass transition temperature (Tg) of the resin is measured, for example, by using the "Diamond DSC" (manufactured by Perkin Elmer Co., Ltd.). In the present specification, as the measurement procedure of the glass transition temperature (Tg), the following method is employed. First, 3.0 mg of the sample (resin) for measurement is sealed in an aluminum pan, and set to the sample holder of the "Diamond DSC". An empty aluminum pan is used for the reference. Thereafter, the DSC curve is obtained by the measurement conditions (temperature raising and cooling conditions), that is, the first temperature raising process to raise the temperature from 0° C. to 200° C. at a temperature rising rate of 10° C./min, a cooling process to cool from 200° C. to 0° C. at a cooling rate of 10° C./min, and the second temperature raising process to raise the temperature from 0° C. to 200° C. at a temperature rising rate of 10° C./min are performed in this order. Based on the DSC curve obtained by this measurement, the extended line of the baseline before the rising of the first endothermic peak in the second temperature raising process and the tangential line indicating the maximum inclination between the rising portion and the peak apex of the first peak are drawn, and the intersection point thereof is adopted as the glass transition temperature (Tg).

In addition, the molecular weight of the vinyl resin measured by gel permeation chromatography (GPC) is preferably from 10,000 to 100,000 as a weight average molecular weight (Mw).

Incidentally, in the present specification, the molecular weight (weight average molecular weight and number average molecular weight) of the resin is the value measured by GPC in the following manner. That is, the apparatus "HLC-8120GPC" (manufactured by Tosoh Corporation) and the column "TSK guard column+TSK gel Super HZ-M three-tiered" (manufactured by Tosoh Corporation) are used. Tetrahydrofuran (THF) as the carrier solvent is circulated at a flow speed of 0.2 mL/min while keeping the column temperature at 40° C. At room temperature, a sample (resin) for measurement is dissolved in tetrahydrofuran in a concentration of 1 mg/mL by using an ultrasonic disperser for 5 minutes, and then the solution is treated with a membrane filter having a pore size of 0.2 μm, thereby obtaining a sample solution. Together with the carrier solvent, 10 μL of this sample solution is injected into the apparatus and detected by using a refractive index detector (RI detector), and the molecular weight distribution of the sample for measurement is calculated by using the calibration curve measured by using monodispersed polystyrene standard particles. About 10 standard polystyrene samples are used for measuring the calibration curve.

<<Other Resins>>

(Polyester Resin)

The binder resin may further contain another resin such as a polyester resin in addition to the vinyl resin. The polyester resin can be produced, for example, by the polycondensation reaction using a carboxylic acid (polycarboxylic acid) and a polyhydric alcohol as a raw material in the presence of an appropriate catalyst.

The polyester resin may be a crystalline polyester resin, an amorphous polyester resin, or a combination thereof, and it is preferably an amorphous polyester resin. The "crystalline polyester resin" refers to a polyester resin which exhibits not a stepwise endothermic change but a clear endothermic peak in differential scanning calorimetry (DSC). The clear endothermic peak specifically means a peak which has a half value width of the endothermic peak of 15° C. or less when differential scanning calorimetry (DSC) is performed at a temperature rising rate of 10° C/min. The "amorphous polyester resin" refers to a polyester resin of which a clear endothermic peak is not observed in differential scanning calorimetry (DSC).

The content of the polyester resin in the binder resin is not particularly limited, but it is preferably less than 50% by mass, more preferably 40% by mass or less, even more preferably 30% by mass or less, even more preferably 20% by mass or less, and even more preferably 10% by mass or less relative to the total amount of the binder resin. By setting the content of the polyester resin to less than 50% by mass, it is possible to decrease the environmental dependency of the electric charge amount due to the hygroscopic property of the polyester resin. Meanwhile, the lower limit value of the content is not particularly limited, but it is preferably 5% by mass or more in a case in which the binder resin contains a polyester resin. The low temperature fixability is excellent when the content of the polyester resin is 5% by mass or more relative to the total amount of the binder resin.

In the present invention, the weight average molecular weight (Mw) of the polyester resin contained in the toner is preferably from 7,000 to 60,000 and more preferably from 12,000 to 30,000. Incidentally, as the weight average molecular weight of the polyester resin, the value determined by the method using GPC described above is adopted.

As described above, the polyester resin is preferably an amorphous polyester resin in a case in which the binder resin further contains a polyester resin. Among them, the amorphous polyester resin is preferably a styrene-acrylic modified polyester resin in light of the affinity with the vinyl resin that is the main component of the binder resin.

Styrene-acrylic Modified Polyester Resin

A styrene-acrylic modified polyester resin refers to a resin in which a polyester resin segment constituted by an amorphous polyester resin and a styrene-acrylic copolymer resin segment constituted by a styrene-acrylic copolymer resin are bonded to each other via a bireactive monomer. The styrene-acrylic copolymer resin segment refers to a polymer moiety obtained by polymerizing an aromatic vinyl monomer with a (meth)acrylic acid ester-based monomer.

The glass transition temperature of the styrene-acrylic modified polyester resin to be used in the present invention is preferably from 50 to 70° C. and more preferably from 50 to 65° C. from the viewpoint of reliably obtaining the fixing properties such as low temperature fixability and the heat resistance such as heat-resistant storage property and blocking resistance. Incidentally, as the glass transition temperature, the value determined by the method using DSC described above is adopted.

The styrene-acrylic modified polyester resin is not particularly limited, but it is preferably a styrene-acrylic modified polyester resin having the following constitution.

The content ratio (hereinafter, also referred to as the "styrene-acrylic modification ratio") of the styrene-acrylic copolymer resin segment in the styrene-acrylic modified polyester resin to be used in the present invention is not particularly limited, but it is preferably 5% by mass or more and 30% by mass or less from the viewpoint of improving the low temperature fixability and the environmental stability of electrification in a good balance.

The styrene-acrylic modification ratio specifically refers to a ratio of the mass of the aromatic vinyl monomer and the (meth)acrylic acid ester-based monomer relative to the total mass of the resin materials to be used for synthesizing the styrene-acrylic modified polyester resin, namely, the total mass of the polymerizable monomer constituting the unmodified polyester resin to constitute the polyester resin segment, the aromatic vinyl monomer and (meth)acrylic acid ester-based monomer to constitute the styrene-acrylic copolymer resin segment, and the bireactive monomer for bonding these segments.

Here, the polyester resin segment is a moiety having the constitutional unit derived from an amorphous polyester resin. As the polycarboxylic acid for forming the moiety, a polycarboxylic acid, an acid anhydride, and an acid chloride can be used. In addition, as the polyhydric alcohol, a polyhydric alcohol and a hydroxycarboxylic acid can be used.

Examples of the polycarboxylic acid may include a dicarboxylic acid such as oxalic acid, succinic acid, maleic acid,adipicacid, β-methyladipicacid, azelaicacid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenyl acetic acid, p-phenylene diacetic acid, m-phenylene diglycolic acid, p-phenylene diglycolic acid, o-phenylene diglycolic acid, diphenyl acetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, or dodecenylsuccinic acid; and a tri- or higher carboxylic acid such as trimellitic acid, pyromellitic acid, naphthalenetricarboxylic acid, or naphthalenetetracarboxylic acid. As the polycarboxylic acid, one kind or more kinds selected from those described above can be used.

As the polycarboxylic acid, it is preferable to use an unsaturated aliphatic dicarboxylic acid such as fumaric acid, maleic acid, or mesaconic acid.

The ratio of the unsaturated aliphatic dicarboxylic acid in the total polycarboxylic acids to be used is preferably from 25 to 75% by mole and even more preferably from 30 to 60% by mole.

Examples of the polyhydric alcohol may include a dihydric alcohol such as ethylene glycol, propylene glycol, butanediol, diethylene glycol, hexanediol, cyclohexanediol, octanediol, decanediol, dodecanediol, ethylene oxide adduct of bisphenol A, or propylene oxide adduct of bisphenol A; and trihydric or higher polyol such as glycerin, pentaerythritol, hexamethylolmelamine, hexaethylolmelamine, tetramethylolbenzoguanamine,ortetraethylolbenzoguanamine. As the polyhydric alcohol, one kind or more kinds selected from those described above can be used.

The polyester resin segment can be produced, for example, by the polycondensation reaction using the polycarboxylic acid and the polyhydric alcohol as a raw material in the presence of an appropriate catalyst. As the catalyst for synthesizing the polyester resin segment, it is possible to use various catalysts known in the prior art.

In addition, the styrene-acrylic copolymer resin segment in the styrene-acrylic modified polyester resin refers to a copolymer moiety having a constitutional unit derived from an aromatic vinyl monomer and a constitutional unit derived from a (meth) acrylic acid ester-based monomer. The aromatic vinyl monomer and the (meth) acrylic acid ester-based monomer to be used for forming the moiety are not particularly limited, and those that are the same as the monomers described in "(1) styrene monomer (aromatic vinyl monomer)" and "(2) (meth)acrylic acid ester-based monomer" mentioned in the section for<<vinyl resin>> are preferably used. Hence, the detailed description on the respective monomers will be omitted here. In addition, as the method for producing the styrene-acrylic copolymer resin segment using these monomers, the method described in the (method for producing vinyl resin) of the section for<<vinyl resin>> is appropriately referenced.

As the aromatic vinyl monomer and (meth)acrylic acid ester-based monomer for forming the styrene-acrylic copolymer resin segment, it is preferable to use larger amount of styrene or a derivative thereof from the viewpoint of obtaining excellent electrification property, and image quality property. Specifically, the amount of styrene or a derivative thereof used is preferably 50% by mass or more in the total monomers (aromatic vinyl monomer and (meth)acrylic acid ester-based monomer) to be used for forming the styrene-acrylic copolymer resin segment.

The styrene-acrylic modified polyester resin further contains a constitutional unit derived from a bireactive monomer in addition to the polyester resin segment and the styrene-acrylic copolymer resin segment.

The bireactive monomer maybe a monomer which has a group capable of reacting with the polycarboxylic acid and/or polyhydric alcohol for forming the polyester resin segment and a polymerizable unsaturated group. Specifically, it is preferable to use (meth)acrylic acid, for example.

As the method for producing the styrene-acrylic modified polyester resin as described above, it is possible to use an existing general scheme, and for example, the following method is preferable.

First, the polyester resin segment is polymerized in advance, and the bireactive monomer is reacted to the polyester resin segment. Thereafter, the constitutional unit derived from the bireactive monomer, the aromatic vinyl monomer and (meth)acrylic acid ester-based monomer for forming the styrene-acrylic copolymer resin segment to form the styrene-acrylic polymer resin segment are reacted one another. The styrene-acrylic modified polyester resin can be produced by such a method.

(Resin other than Polyester Resin)

The binder resin may further contain other resins to be exemplified below in addition to the vinyl resin as the main component. Examples thereof may include an epoxy resin, an epoxy polyol resin, a urethane resin, and a polyamide, and these can be used singly or as mixture of two or more kinds thereof.

<Aluminum>

The toner base particles according to the present invention contain aluminum at a concentration of from 900 to 2,200 ppm in addition to the binder resin described above. Incidentally, in the present specification, the concentration of aluminum is the value measured by ICP emission spectral analysis, and more specifically, it is the value measured by the method described in Examples.

As described above, aluminum in the toner base particles is present as an aluminum ion and forms a crosslinked structure with the acid group in the vinyl resin. At this time, the aluminum ion is present as a trivalent ion and thereby has three bonding arms, and thus it can form a three-dimensional crosslinked structure. In contrast, a monovalent or divalent ion has one or two bonding arms, and thus it cannot sufficiently form a crosslinked structure, and thereby hardly contribute to the improvement of elasticity of the toner base particles.

In the toner base particles according to the present invention, sufficient crosslinked structures are formed as aluminum is contained therein at the concentration described above. Moreover, moderate elasticity is imparted to the toner base particles by such a crosslinked structure and it is possible to improve the environmental stability of electrification, and the glossiness and the image density of the image to be formed in a good balance without impairing the low temperature fixability. Hence, when the concentration of aluminum is low (namely, less than 900 ppm), sufficient crosslinked structures are not formed, the elasticity of the toner base particles is insufficient, and the effect of improving glossiness and the image density of the image cannot be obtained. In contrast, when the concentration of aluminum is high (namely, greater than 2,200 ppm), the crosslinked structures are excessive, the elasticity of the toner base particles increases too high, and favorable low temperature fixability cannot be maintained. In addition, the toner particles are highly polarized and thereby exhibit high hygroscopic property since the content of the ionic substance is too high, and as a result, the environmental stability of the electric charge amount decreases.

Furthermore, the concentration of aluminum is more preferably from 1,000 to 2,000 ppm, more preferably from 1,200 to 1,800 ppm, even more preferably from 1,200 to 1,700 ppm, and even more preferably from 1,300 to 1,650 ppm in order to improve the effect of the present invention.

The supply source of aluminum (supply source of aluminum ion) contained in the toner base particles is not particularly limited, and examples thereof may include a metal salt such as aluminum chloride, aluminum bromide, aluminum iodide, aluminum sulfate, or aluminum nitrate; and a polymer of an inorganic metal salt such as polyaluminum chloride or polyaluminum hydroxide. As the supply source of aluminum, one kind or more kinds selected from those described above can be used.

The method for producing the toner base particles containing aluminum is not particularly limited, and examples thereof may include a method in which the toner base particles are prepared by an emulsion aggregation method and a compound to be the supply source of aluminum described above is used as the aggregating agent at this time. Hence, it is preferable to use aluminum chloride, aluminum sulfate, polyaluminum chloride, and polyaluminum hydroxide as the supply source of aluminum in light of the utility as an aggregating agent.

In addition, the concentration of aluminum in the toner base particles can be controlled by appropriately adjusting the addition amount of the supply source of aluminum relative to the addition amount of the constitutional components of the toner base particles such as the binder resin.

<Other Metals>

The toner base particles to be used in the present invention may contain a metal other than aluminum described above as long as the effect of the present invention is not impaired. Examples of such a metal may include a metal derived from the aggregating agent to be used in the case of preparing the toner base particles by an emulsion aggregation method.

The aggregating agent is not particularly limited, and examples thereof may include a chloride or sulfate of a divalent metal. Hence, the toner base particles may contain a divalent metal derived from the aggregating agent described above. Specific examples of the aggregating agent may include magnesium chloride, magnesium sulfate, iron (II) chloride, iron(II) sulfate, calcium chloride, and calcium sulfate. Consequently, the toner base particles may further contain at least one selected from the group consisting of magnesium, iron, and calcium.

The concentration of the metal in the toner base particles is not particularly limited as long as the effect of the present invention is not impaired, but it is preferably 1,000 ppm or less, more preferably 800 ppm or less, and even more preferably 500 ppm or less. It is possible to decrease the environmental dependency of the electric charge amount caused by high polarization of the toner base particles due to the metal when the concentration is in the above range. On the other hand, it is more preferable as the lower limit of the concentration of the metal is lower, and the lower limit of the concentration is greater than 0 ppm in the case of containing these metals. Incidentally, it is preferable that the total concentration of these is in the above range in the case of containing two or more kinds of metals other than aluminum.

<Other Constitutional Components>

The toner base particles to be used in the present invention may contain a colorant, a release agent (wax), and a charge control agent if necessary.

(Colorant)

As the colorant to be used in the toner, it is possible to arbitrarily use carbon black, a magnetic material, a dye, and a pigment. Channel black, furnace black, acetylene black, thermal black, lamp black or the like can be used as the carbon black. It is possible to use a ferromagnetic metal such as iron, nickel, or cobalt, any alloy containing these metals, a compound of a ferromagneticmetal such as ferrite or magnetite, or the like as the magnetic material.

As the dye, it is possible to use C.I. Solvent Red 1, 49, 52, 58, 63, 111, and 122, C.I. Solvent Yellow 19, 44, 77, 79, 81, 82, 93, 98, 103, 104, 112, and 162, and C.I. Solvent Blue 25, 36, 60, 70, 93, and 95, and a mixture of these can also be used. As the pigment, it is possible to use C. I. Pigment Red 5, 48:1, 48:3, 53:1, 57:1, 81:4, 122, 139, 144, 149, 166, 177, 178, and 222, C.I. Pigment Orange 31 and 43, C.I. Pigment Yellow 14, 17, 74, 93, 94, 138, 155, 180, and 185, C.I. Pigment Green 7, and C.I. Pigment Blue 15:3, 15:4, or 60, and a mixture of these can also be used. The number average primary particle size widely varies depending on the kind, and it is preferably about from 10 to 200 nm.

(Release Agent)

It is possible to contain a release agent in the toner. Examples of the release agent may include a hydrocarbon wax such as low molecular weight polyethylene wax, low molecular weight polypropylene wax, Fischer-Tropsch wax, microcrystalline wax, or paraffin wax and an ester wax such as carnauba wax, pentaerythritolbehenate, behenylbehenate, or behenyl citrate. These release agents may be used singly or in combination of one kind or more kinds thereof.

The content ratio of the release agent is preferably from 2 to 20% by mass, more preferably from 3 to 18% by mass, and even more preferably from 4 to 15% by mass relative to the total amount of the binder resin.

In addition, the melting point of the release agent is preferably from 50 to 95° C. from the viewpoint of low temperature fixability and mold release property of the toner in electrophotography.

(Charge Control Agent)

As the charge control agent constituting the charge control agent particles, it is possible to use those that are various known ones and can be dispersed in an aqueous medium. Specific examples thereof may include a nigrosine-based dye, a metal salt of naphthenic acid or higher fatty acid, an alkoxylated amine, a quaternary ammonium salt compound, an azo-based metal complex, a metal salt of salicylic acid, or a metal complex thereof.

The number average primary particle size of these charge control agent particles in a dispersed state is preferably about from 10 to 500 nm.

[Form of Toner Base Particles]

The form of the toner base particles according to the present invention is not particularly limited, and for example, it may be a so-called single-layer structure (not a core-shell type, but homogeneous structure), a core-shell structure, a multilayer structure composed of three or more layers, or a domain-matrix structure. It is preferable that the toner base particles have a core-shell structure having core particles and a shell layer covering the core particle surface for purpose of improving the storage stability of the toner.

<Core-shell Structure>

The particles having a core-shell structure specifically have a resin region (shell layer) having a relatively high glass transition temperature on the surface of a resin region (core particles). The resin region (core particles) contains a colorant, a release agent, or the like to be added if necessary and has a relatively low glass transition temperature. The cross-sectional structure of such a core-shell structure can be confirmed, for example, by using a known means such as a transmission electron microscope (TEM) or a scanning probe microscope (SPM).

Incidentally, the core-shell structure is not limited to a structure in which the shell layer completely covers the core particles, and it also includes, for example, a structure in which the shell layer does not completely cover the core particles, and the core particles are exposed in some places.

The resins constituting the core particle and the shell layer are not particularly limited as long as they satisfy the properties regarding the glass transition temperature described above.

<<Core Particles>>

As the binder resin constituting the core particles is not particularly limited, and for example, it is possible to use the vinyl resin, the styrene-acrylic modified polyester resin, and the polyester resin which are described above. As these resins, one kind or more kinds selected from those described above can be used.

Among them, the core particles preferably contain the vinyl resin described above and preferably contain the styrene-acrylic copolymer resin in particular. At this time, the content ratio of the styrene-acrylic copolymer resin is preferably from 70 to 100% by mass and more preferably from 90 to 100% by mass relative to 100% by mass of the binder resin constituting the core particles.

<<Shell Layer>>

The binder resin constituting the shell layer is not particularly limited, and for example, the vinyl resin described above,the styrene-acrylic modified polyester resin, and the polyester resin which are described above, and a urethane resin. As these resins, one kind or more kinds selected from those described above can be used.

Among them, the shell layer preferably contains the vinyl resin or styrene-acrylic modified polyester resin which is described above, even more preferably contains the vinyl resin, and even more preferably contains the styrene-acrylic copolymer resin.

In a case in which the shell layer contains the vinyl resin (preferably styrene-acrylic copolymer resin), the content ratio of the vinyl resin (preferably styrene-acrylic copolymer resin) is preferably from 70 to 100% by mass and more preferably from 90 to 100% by mass relative to 100% by mass of the binder resin (resin for shell) constituting the shell layer.

In addition, the shell layer may contain the styrene-acrylic modified polyester resin as described above. The following effects can be obtained by using the styrene-acrylic modified polyester resin in the resin for shell constituting the toner.

That is, in general, the advantage of using a polyester resin as the binder resin in the design of the toner particles is that a design is easily performed in which the softening point of the binder resin is lowered while maintaining a higher glass transition temperature (Tg) of the polyester resin as compared to a styrene-acrylic resin. That is, a polyester resin is a suitable resin for satisfying both the low temperature fixability and the heat-resistant storage property. Moreover, when the core particles contain the vinyl resin (in particular, styrene-acrylic copolymer resin), by introducing a styrene-acrylic copolymer resin segment to the polyester resin used for the shell layer, the affinity between the polyester resin of the shell layer and the styrene-acrylic resin of the core particles is enhanced while maintaining the high glass transition temperature and low softening point of the polyester resin. This makes it possible to form a shell layer which has a more uniform film thickness while being a thin layer and has a smooth surface. Hence, according to the toner base particles having the form described above, it is possible to obtain a toner exhibiting excellent low temperature fixability or excellent heat-resistant storage property.

In the above form, the content ratio of the styrene-acrylic modified polyester resin is preferably from 70 to 100% by mass and more preferably from 90 to 100% by mass relative to 100% by mass of the resin for shell. Sufficient affinity between the core particle and the shell layer can be obtained when the content ratio of the styrene-acrylic modified polyester resin in the resin for shell is in the above range. As a result, it is possible to form a thin and uniform shell layer, and thus the heat-resistant storage property and the fracture resistivity are improved and the electrification property are improved.

<Form of Core-shell Structure>

A preferred form of the toner base particles having a core-shell structure includes, a form in which the vinyl resin described above is contained in the core particle and the shell layer. The vinyl resin contained in the core particles and the vinyl resin contained in the shell layer are ionically crosslinked via aluminum as the toner base particles having such a form contain aluminum at the predetermined concentration described above. Hence, a crosslinked structure is firmly formed at the interface between the core particle and the shell layer, and thus it is easier to form an ideal core-shell structure. As a result, the heat resistance is improved, and further the low temperature fixability is improved in association with this. Furthermore, according to the above form, the fracture resistivity, such that the toner particles would not be crushed even when being stirred in the developing device and being exposed to stress, is sufficiently obtained since the shell layer is not easily peeled off. As a result, an image which has a high image quality without an image noise can be obtained, for example, even in a high-function machine such as a high-speed machine. Incidentally, in the above form, it is preferable that the vinyl resins contained in the core particle and the shell layer are both a styrene-acrylic copolymer resin in order to improve the effect of the present invention.

In addition, another form includes, a form in which the vinyl resin (more preferably, styrene-acrylic copolymer resin) described above is contained in the core particle and the amorphous polyester resin (more preferably, styrene-acrylic modified polyester resin) described above is contained in the shell layer. According to such a form, a toner exhibiting excellent low temperature fixability and excellent heat resistant storage property can be obtained.

The content of the core particles is preferably from 50 to 95% by mass and more preferably from 60 to 90% by mass relative to 100% by mass of the total resin amount (total amount of binder resin) of the core particles and the shell layer. In addition, the content of the shell layer is preferably from 5 to 50% by mass and more preferably from 10 to 40% by mass relative to 100% by mass of the total resin amount (total amount of binder resin) of the core particles and the shell layer. When the content ratio of the resin for shell in the binder resin in the toner is within the above range, it is possible to achieve both the low temperature fixability and the heat-resistant storage property.

<Average Circularity>

The average circularity of the toner base particles is preferably from 0.920 to 1.000 and more preferably from 0.940 to 0.995 from a viewpoint of improving the environmental stability of electrification and low temperature fixability. Here, the average circularity is the value measured by using the "FPIA-2100" (manufactured by Sysmex Corporation).

Specifically, the toner base particles are wetted in an aqueous solution of a surfactant, subjected to the ultrasonic dispersion for 1 minute to be dispersed, and subjected to the measurement at a proper concentration having a HPF detection number of 4,000 by using the "FPIA-2100" under the measurement conditions of a HPF (high magnification imaging) mode. The circularity is calculated by the following equation.

Circularity=(circumferential length of a circle having an equivalent to a projected area of a particle image)/(circumferential length of a projected image of a particle)

In addition, the average circularity is the arithmetic mean value obtained by summing the circularities of the respective particles and dividing the sum by the total number of particles measured.

<Particle Size>

The particle size of the toner base particles is preferably from 3 to 10 μm as the volume-based median diameter ($D_{50}$).

By setting the volume-based median diameter to be in the above range, it is possible to cut down the consumption amount of toner as compared to the case of using a toner having a greater particle size as well as it is possible to achieve the reproducibility of a thin line or the high image quality of a photographic image. In addition, the fluidity of toner can be secured.

The volume-based median diameter ($D_{50}$) of the toner base particles can be measured and calculated, for example, by using an apparatus prepared by connecting the computer system for data processing to the "Multisizer 3 (manufactured by Beckman Coulter, Inc.)".

As the measurement procedure, 0.02 g of the toner base particles is mixed thoroughly and evenly with 20 ml of a surfactant solution (for example, a surfactant solution prepared by diluting a neutral detergent containing a surfactant component with pure water by 10-fold for the purpose of dispersing the toner base particles) and then subjected to the ultrasonic dispersion for 1 minute to prepare a dispersion of toner particles. This dispersion of toner base particles is injected into the beaker containing the ISOTONII (registered trademark; manufactured by Beckman Coulter, Inc.) in the sample stand by using a pipette until to have a measurement concentration of from 5 to 10%, the count of the measuring machine is set to 25000, and the measurement is conducted. Incidentally, the aperture diameter of the Multisizer 3 used is 100 μm. The number of frequency when the range of the measurement range of from 1 to 30 μm is divided into 256 is calculated, and the particle size at 50% from the greater volume cumulative fraction is adopted as the volume-based median diameter ($D_{50}$).

The volume-based median diameter of the toner can be controlled by the concentration of the aggregating agent, the addition amount of the solvent, or the fusion time in the aggregation and fusion step at the time of producing the toner to be described later and further by the composition of the resin component or the like.

[External Additive]

The toner base particles according to the present invention can be used as toner particles as they are, but it is preferable to add known particles such as inorganic fine particles or organic fine particles, a lubricant, and the like to the surface of the toner base particles as an external additive from the viewpoint of improving the electrification performance or fluidity as a toner or cleaning property. As the external additive, various ones maybe used in combination. Examples of the particles may include fine particles of an inorganic oxide such as silica fine particles, alumina fine particles, and titania fine particles, fine particles of an inorganic stearic acid compound such as aluminum stearate fine particles or zinc stearate fine particles, or fine particles of an inorganic titanium acid compound such as strontium titanate fine particles, zinc titanate fine particles. Examples of the lubricant may include metal salts of higher fatty acids such as zinc, aluminum, copper, magnesium, and calcium salts of stearic acid, zinc, manganese, iron, copper, and magnesium salts of oleic acid, zinc, copper, magnesium, and calcium salts of palmitic acid, zinc and calcium salts of linoleic acid, and zinc and calcium salts of ricinoleic acid. These external additives may be those that are subjected to the surface treatment by a silane coupling agent or a titanium coupling agent, a higher fatty acid, silicone oil, or the like from the viewpoint of heat-resistant storage property and environmental stability.

The addition amount of these external additives is preferably from 0.05 to 5 parts by mass relative to 100 parts by mass of the toner base particles.

Among the above, fine particles of an inorganic oxide such as silica fine particles, alumina fine particles, and titania fine particles are preferably used as the external additive. At this time, it is particularly preferable to use silica fine particles (silica particles) having a number average primaryparticle size of from 60 to 150 nm. Such silica fine particles (spherical silica) have a relatively great size and can exert a high spacer effect. Hence, the silica fine particles can suppress the embedding or movement of not only themselves but also other external additives including titania fine particles. As a result, it is possible to suppress a decrease in electric charge amount due to the deterioration of the toner under high stress in a low coverage mass print or the like and further a decrease in image quality of an output image associated therewith.

Incidentally, the number average primary particle size of the external additive fine particles can be calculated from an electron micrograph. In the present specification, the "number average primary particle size" is the value calculated by the following procedure.

(1) A photograph of the toner is taken at a magnification of 30,000-fold by a scanning electron microscope, and this photographic image is captured by a scanner;

(2) The external additive particles (titania fine particles, silica fine particles, and the like) present on the surface of the toner in the photographic image are subjected to the binary coded processing by an image processing analysis apparatus "LUZEX AP (manufactured by Nireco Corporation), the horizontal Feret diameter is calculated for 10,000 particles, and the average thereof is adopted as the number average primary particle size.

[Method for Producing Toner for Developing Electrostatic Charge Image]

Hereinafter, the method for producing a toner for electrostatic charge image development according to the present invention will be described.

The method for producing a toner of the present invention is not particularly limited, and examples thereof may include known methods such as a kneading pulverization method, a suspension polymerization method, an emulsion aggregation method, a dissolution suspension method, a polyester extension method, and a dispersion polymerization method.

Among these, it is preferable to employ an emulsion aggregation method from the viewpoint of uniformity of the particle size, controllability of the shape, and easiness of formation of the core-shell structure. Hereinafter, the emulsion aggregation method will be described.

(Emulsion Aggregation Method)

The emulsion aggregation method is a method to produce toner particles by mixing a dispersion of the particles of the binder resin (hereinafter, also referred to as the "binder resin particles") dispersed by using a surfactant or a dispersion stabilizer with a dispersion of the particles of a colorant (hereinafter, also referred to as the "colorant particles") if necessary, aggregating the particles until to have a desired toner particle size, and further conducting the fusion among the binder resin particles to control the shape. Here, the particles of the binder resin may arbitrarily contain a release agent, a charge control agent, and the like.

As a preferred method for producing a toner according to the present invention, an example in the case of obtaining toner particles having a core-shell structure by using the emulsion aggregation method will be presented below.

(1) A step of preparing a dispersion of colorant particles having colorant particles dispersed in an aqueous medium (2) A step of preparing a dispersion of resin particles (dispersion of resin particles for core/shell) having binder resin particles containing an internal additive if necessary dispersed in an aqueous medium (3) A step of mixing the dispersion of colorant particles and the dispersion of resin particles for core to obtain a dispersion of resin particles for aggregation and aggregating and fusing the colorant particles and the binder resin particles in the presence of a compound to be the supply source of aluminum to form aggregated particles as the core particles (aggregation and fusion step)

(4) A step of adding the dispersion of resin particles for shell containing the binder resin particles for shell layer into the dispersion containing the core particles and aggregating and fusing the particles for shell layer on the surface of the core particles to form the toner base particles having a core-shell structure (aggregation and fusion step)

(5) A step of separating the toner base particles from the dispersion of the toner base particles through filtration and removing the surfactant or the like (cleaning step)

(6) A step of drying the toner base particles (drying step)

(7) A step of adding an external additive to the toner base particles (step of treating with external additive).

The toner particles having a core-shell structure can be obtained by first aggregating and fusing the binder resin particles for core particles and the colorant particles to produce core particles, subsequently adding the binder resin particles for shell layer into the dispersion of core particles, and aggregating and fusing the binder resin particles for shell layer on the surface of the core particles to form a shell layer covering the surface of the core particles. On the other hand, for example, in the step (4) above, it is also possible to produce the toner particles formed of particles of a single layer in the same manner without adding the dispersion of resin particles for shell.

Hereinafter, the respective steps will be described.

<Step (1): Step of Preparing Dispersion of Colorant Particles>

The step of preparing a dispersion of colorant particles is a step to prepare a dispersion of colorant particles by dispersing the colorant in an aqueous medium in the form of fine particles.

In the present invention, the term "aqueous medium" refers to a medium composed of water at from 50 to 100% by mass and a water-soluble organic solvent at from 0 to 50% by mass. Examples of the water-soluble organic solvent may include methanol, ethanol, isopropanol, acetone, and tetrahydrofuran. An alcohol-based organic solvent which does not dissolve the resin to be obtained is preferable. More preferably, only water is used as the aqueous medium.

A cationic surfactant such as dodecyl ammonium bromide, a nonionic surfactant such as dodecyl polyoxyethylene ether, and an anionic surfactant such as sodium lauryl sulfate (sodium dodecyl sulfate) may be added into the aqueous medium for the purpose of improving the dispersion stability.

Dispersion of the colorant can be conducted by utilizing mechanical energy, and such a disperser is not particularly limited, and it is possible to use a homogenizer, a low-speed shearing type disperser, a high-speed shearing type disperser, a friction type disperser, a high-pressure jet type disperser, an ultrasonic disperser, a high-pressure impact type disperser ULTIMIZER, and the like.

The content of the colorant in the colorant dispersion is set to be preferably in a range of from 10 to 50% by mass and more preferably in a range of from 15 to 40% by mass. An effect of securing the color reproducibility can be obtained when the content is in such a range.

The particle size of the colorant particles is preferably from 10 to 300 nm as a volume-based median diameter.

(Measurement of Dispersed Particle Size in Dispersion of Colorant Particles)

The dispersed particle size of the colorant particles in the aqueous medium is the volume average particle size, namely, the volume-based median diameter, and this median diameter is the value measured by using the Microtrac particle size distribution measuring apparatus "UPA-150" (manufactured by NIKKISO CO., LTD.) under the following measurement conditions.

(Measurement Conditions)

(1) Refractive index of sample: 1.59

(2) Specific gravity of sample: 1.05 (in terms of spherical particle)

(3) Refractive index of solvent: 1.33

(4) Viscosity of solvent: 0.797 at 30° C. and 1.002 at 20° C.

The measurement is conducted after ion-exchanged water is introduced into the measurement cell and the zero point is adjusted.

<Step (2): Step of Preparing Dispersion of Resin Particles (Dispersion of Resin Particles For Core/Shell) >

The step of preparing a dispersion of resin particles is a step to prepare a dispersion of binder resin particles by synthesizing the binder resin constituting the toner base particles and dispersing these binder resin particles in an aqueous medium in the form of fine particles.

Examples of the method for dispersing the binder resin in an aqueous medium may include a method (I) in which the binder resin particles are formed from a monomer for obtaining the binder resin and an aqueous dispersion of the binder resin particles is prepared and a method (II) in which an oil phase liquid is prepared by dissolving or dispersing a binder resin in an organic solvent (solvent) and oil droplets in a state of being controlled to have a desired particle size is formed by dispersing the oil phase liquid in an aqueous medium by phase-transfer emulsification or the like, and the organic solvent (solvent) is then removed. These methods (I) and (II) can be appropriately selected depending on the kind of the binder resin. In the present step, it is preferable to use the method (I) in the case of preparing a dispersion of vinyl resin particles and the method (II) in the case of preparing a dispersion of other binder resin particles (for example, polyester resin particles).

(Method (I))

In the method (I), first, a monomer for obtaining the vinyl resin is added into the aqueous medium together with a polymerization initiator and polymerized to obtain the basic particles. At this time, a water-soluble polymerization initiator can be used as the polymerization initiator. As the water-soluble polymerization initiator, it is possible to preferably use a water-soluble radical polymerization initiator such as potassium persulfate or ammonium persulfate.

In addition, the aqueous medium is as described in the section for <Step (1): step of preparing dispersion of colorant particles>, and a surfactant such as sodium dodecyl sulfate may be added into the aqueous medium for the purpose of improving the dispersion stability.

Next, it is preferable to use a technique in which a radically polymerizable monomer for obtaining the vinyl resin and a polymerization initiator are added to the basic particles and the radically polymerizable monomer is seed polymerized to the basic particles.

In addition, it is possible to use a generally used chain transfer agent in the seed polymerization reaction system for obtaining the vinyl resin particles for the purpose of adjusting the molecular weight of the vinyl resin. As the chain transfer agent, it is possible to use a mercaptan such as octylmercaptan, dodecylmercaptan, or t-dodecylmercaptan; mercaptopropionic acid such as n-octyl-3-mercaptopropionate, stearyl-3-mercaptopropionate; and styrene dimer. These may be used singly or in combination of two or more kinds thereof.

Incidentally, in the method (I), a release agent may be contained in the vinyl resin particles by dispersing the release agent together with the monomer when the vinyl resin particles are formed from a monomer for obtaining the vinyl resin. In addition, a dispersion of the vinyl resin particles may be prepared through multi-step polymerization by further conducting the seed polymerization reaction.

(Method (II))

In the method (II), as the organic solvent (solvent) to be used in the preparation of the oil phase liquid, the solvents that have a low boiling point and low solubility in water are preferable from the viewpoint of being easy to remove the organic solvent after the formation of oil droplets in the same manner as the above, and specifically, examples thereof may include methyl acetate, ethyl acetate, methyl ethyl ketone, methyl isobutyl ketone, toluene, and xylene. These can be used singly or in combination of two or more kinds thereof.

The amount of organic solvent (solvent) used (total used amount in the case of using two or more kinds) is usually from 10 to 500 parts by mass and preferably from 100 to 450 parts by mass relative to 100 parts by mass of the binder resin.

The amount of the aqueous medium used is preferably from 50 to 2,000 parts by mass and more preferably from 100 to 1,000 parts by mass relative to 100 parts by mass of the oil phase liquid. The oil phase liquid can be emulsified and dispersed in the aqueous medium so as to have a desired particle size by setting the amount of the aqueous medium used to be within the above range.

In addition, in the same manner as the above, a surfactant may be added into the aqueous medium for the purpose of improving the dispersion stability of the oil droplets.

Such emulsification and dispersion of the oil phase liquid can be conducted by utilizing the mechanical energy, and the disperser for conducting the emulsification and dispersion is not particularly limited, and those described in the section for <Step (1): step of preparing dispersion of colorant particles>can be used.

Removal of the organic solvent after formation of the oil droplets can be conducted by an operation of gradually increasing the temperature of the whole dispersion in which the binder resin particles are dispersed in an aqueous medium, in a stirred state, vigorously stirring the dispersion in a certain temperature range, and then carrying out the desolvation, and the like. Alternatively, the organic solvent can be removed while reducing the pressure by using a device such as an evaporator.

The particle size of the binder resin particles (oil droplets) in the dispersion of resin particles prepared by the method (I) or (II) above is preferably from 60 to 1000 nm and more preferably from 80 to 500 nm as a volume-based median diameter. Incidentally, this volume average particle size is measured by the same method as the dispersed particle size in the dispersion of colorant particles. Incidentally, the volume average particle size of the oil droplets can be controlled by the magnitude of mechanical energy at the time of emulsification and dispersion.

In addition, the content of the binder resin particles in the dispersion of binder resin particles is set to be preferably in a range of from 5 to 50% bymass andmore preferably from 10 to 40% by It is possible to suppress the spread of particle size distribution and to improve the properties of the toner when the content is in such a range.

<Steps (3) and (4): Aggregation and Fusion Step>

This aggregation and fusion step is a step of obtaining the toner base particles by aggregating the binder resin particles described above in an aqueous medium and the colorant particles to be added if necessary and fusing these particles at the same time with the aggregation.

(Step (3): Step of Forming Core Particles)

As the method for forming the core particles, a known method can be used, and the emulsion aggregation method to form the core particles by aggregating the resin particles dispersed in an aqueous medium is preferably used.

The core particles are usually formed by the emulsion aggregation method in a case in which the core particles have a constitution formed by aggregating/fusing the binder resin particles containing the vinyl resin and the like. Here, the step of aggregating and associating the binder resin particles with the colorant particles by the emulsion aggregation method is described.

In the present step, a dispersion of resin particles for aggregation is prepared by mixing the dispersion of resin particles (dispersion of resin particles for core), the dispersion of colorant particles to be added if necessary and the dispersion of the particles of other toner constitutional components, and the resin particles and the like are aggregated and fused in an aqueous medium to prepare a dispersion of aggregated particles.

In the present invention, it is preferable to use a method in which aggregated particles are formed by using the dispersion of resin particles for aggregation in the presence of a compound to be the supply source of aluminum and the aggregated particles are fused by being heated. That is, it is preferable that the compound to be the supply source of aluminum is a compound to serve a function of an aggregating agent. In the above form, there is an advantage that a decrease in physical properties of the toner due to an extra additive can be suppressed and the producing process can be also simplified. The compound to be the supply source of aluminum is described above, and thus the detailed description thereon is omitted here. Incidentally, the chloride or sulfate of a divalent metal described above maybe added as the aggregating agent in addition to the compound to be the supply source of aluminum.

The amount of the compound to be the supply source of aluminum used is not particularly limited, and it is, for example, from 5 to 30 parts by mass and preferably from 8 to 25 parts by mass relative to 100 parts by mass of the solid content in the binder resin constituting the toner base particles (here, the total amount of these resins is taken as 100 parts by mass in a case in which the toner is constituted by two or more kinds of resins such as particles having a core-shell structure). The concentration of aluminum in the toner base particles is likely to be controlled in the desired range when the amount of the compound to be the supply source of aluminum used is in the above range although it also depends on the kind of the compound.

In addition, when the chloride or sulfate of a divalent metal is added as an aggregating agent, the amount thereof used is not particularly limited as long as the effect of the present invention is not impaired. It is, for example, from 5 to 25 parts by mass and preferably from 8 to 20 parts by mass relative to 100 parts by mass of the solid content in the binder resin constituting the toner base particles.

The compound to be the supply source of aluminum may be added to the dispersion of resin particles for aggregation in the form as it is, or the compound in the state of being dissolved or dispersed in an aqueous medium in advance may be added to the dispersion of resin particles for aggregation. The form to add the compound to be the supply source of aluminum to the dispersion of resin particles for aggregation is also not particularly limited, and preferably the compound is added over from 1 to 20 minutes while being stirred.

In the aggregation step, it is preferable that a time period during which the dispersion is allowed to stand after the addition of the compound to be the supply source of aluminum as an aggregating agent (until heating is started) is set as short as possible. That is, it is preferable to start heating of the dispersion of resin particles for aggregation as quickly as possible after the compound to be the supply source of aluminum is added thereto and to raise the temperature to the glass transition temperature or higher of the resin for core. The reason for this is not clear, but this is because it is concerned that the aggregation state of the particles varies with the passage of the standing time and thus a problem might be caused that the particle size distribution of the toner particles to be obtained is unstable or the surface property fluctuates. The standing time is usually within 30 minutes and preferably within 10 minutes.

In addition, in the aggregation step, it is preferable to quickly raise the temperature by heating and to set the temperature rising rate to 1° C./min or more. The upper limit of the temperature rising rate is not particularly limited, but it is preferable to set the upper limit to 15° C./min or less from the viewpoint of suppressing the generation of coarse particles due to the rapid progress of fusion. Furthermore, it is important to continue the fusion by keeping the temperature of the dispersion of resin particles for aggregation for a certain time after the temperature of the dispersion of resin particles for aggregation reaches the glass transition temperature or higher. This makes it possible to effectively advance the growth and fusion of particles and to improve the durability of the toner particles to be finally obtained.

(Step (4): Step of Forming Shell Layer)

It is preferable to employ the emulsion aggregation method in the case of uniformly forming a shell layer on the surface of core particles. In the case of employing the emulsion aggregation method, it is possible to form the shell layer by adding an emulsified dispersion of shell particles (dispersion of resin particles for shell) in the aqueous dispersion of the core particles and aggregating/fusing the shell particles on the surface of the core particles.

Specifically, the dispersion of resin particles for shell is added to the dispersion of core particles in the state of maintaining the temperature for conducting the aggregation and fusion and the resin particles for shell are gradually covered on the surface of the core particles while being continuously heated and stirred.

Thereafter, the particle growth is terminated, for example, by adding a terminating agent such as sodium chloride at the stage at which the associated particles have a desired particle size, and the liquid containing the associated particles is continuously heated and stirred. The toner base particles are prepared by adjusting the heating temperature, the stirring speed, and the heating time until the shape of the associated particles has a desired circularity as described above. The conditions for heating and stirring are not particularly limited. By these, toner base particles having a desired circularity and a uniform shape can be obtained.

Thereafter, preferably, the association solution containing the toner base particles is subjected to the cooling treatment to obtain a dispersion of toner base particles.

(Step (5): Cleaning Step)

The filtration treatment method for separating the toner base particles from the dispersion of toner base particles through filtration is not particularly limited, and there are a centrifugation method, a vacuum filtration method to be carried out by using the Nutsche or the like, and a filtration method to be carried out by using a filter press or the like.

Next, a cleaning treatment to remove the deposits such as a surfactant or a salting-out agent from the toner base particles subjected to the solid-liquid separation is conducted. For example, the cleaning treatment is conducted by using water or an alcohol and preferably using water.

Cleaning by using water is preferably continued until the electric conductivity of the filtrate reaches 50 μS/cm or less. It is preferable that cleaning is conducted until the electric conductivity of the filtrate reaches 50 μS/cm or less since the residual amount of impurities adhered to the toner particles decreases. Furthermore, the amount of impurities adhered to the toner particles further decreases when cleaning is conducted until the electric conductivity of the filtrate reaches 10 μS/cm or less. Here, the electric conductivity of the filtrate can be measured by a normal electric conductivity meter.

Water to be used for cleaning is not particularly limited, but it is preferable to use water having an electric conductivity of 5 μS/cm or less in order to have the electric conductivity of the filtrate of 50 μS/cm or less. Furthermore, water of which the cleaning performance is enhanced by dividing the cluster of water by magnetism or ultrasonic waves may be used.

(Step (6): Drying Step)

Thereafter, the toner base particles collected through the cleaning step is subjected to the drying treatment to obtain dried toner base particles. Examples of the dryer to be used in this step may include a spray dryer, a vacuum freeze dryer, and a vacuum dryer, and it is preferable to use a static shelf dryer, a mobile rack dryer, a fluidized bed dryer, a rotary dryer, a stirring dryer, and the like. The moisture in the dried toner base particles is preferably 5% by mass or less and even more preferably 2% by mass or less. Incidentally, the aggregates may be subjected to the crushing treatment in a case in which the toner particles subjected to the drying treatment are aggregated via a weak attractive force between the particles. Here, it is possible to use a mechanical crushing apparatus such as a jet mill, the Henschel mixer, a coffee mill, a food processor as the apparatus for crushing treatment.

(Step (7): Step of Treating with External Additive)

In the present invention, an external additive can be added to the toner for the purpose of improving the fluidity or electrification property of the toner. Incidentally, the materials that can be used as the external additive are described above, and thus the detailed description thereon is omitted here.

Examples of the method for adding the external additive, a dry method in which the external additive is added to the dried toner base particles in the form of a powder, and examples of the mixing apparatus may include a mechanical mixing apparatus such as the Henschel mixer or a coffee mill.

[Developer]

The toner according to the present invention can be used as a two-component developer composed of a carrier and the toner or a non-magnetic one-component developer composed of the toner only.

As the carrier that is magnetic particles to be used when the toner is used as a two-component developer, for example, it is possible to use the materials known in the art such as metals such as iron, ferrite, or magnetite, and alloys of these metals with metals such as aluminum and lead. The ferrite particles are preferable among these. In addition, as the carrier, a coated carrier in which the surface of the magnetic particles is covered with a covering agent such as a resin such as a (meth)acrylic resin or a resin dispersion type carrier formed by dispersing a fine magnetic material powder in a binder resin may be used. The volume average particle size of the carrier is preferably from 15 to 100 μm and more preferably from 25 to 80 μm.

EXAMPLES

Hereinafter, embodiments of the present invention will be specifically described with reference to Examples, but the present invention is not limited thereto. In the following Examples, the terms "parts", "%", and "ppm" respectivelymeans "parts by mass", "% by mass", and "ppm by mass" and the respective operations were conducted at room temperature (25° C.) unless otherwise stated. In addition, the glass transition temperature and weight average molecular weight of the respective resins were measured by the methods described above.

<Production of Toner>

Production Example 1

Preparation of Dispersion of Colorant Particles

In 1,600 parts by mass of ion-exchanged water, 90 parts by mass of sodium dodecyl sulfate was dissolved by stirring. While stirring this solution, 420 parts by mass of the carbon black "MOGUL (registered trademark) L" (manufactured by Cabot Corporation) as the colorant particles was gradually added to the solution.

Subsequently, a "dispersion of colorant particles" in which the colorant particles were dispersed was prepared by subjecting the mixture to the dispersion treatment by using the mechanical disperser "CLEARMIX (registered trademark)" (manufactured by M Technique Co., Ltd.). The particle size of the colorant particles in this dispersion was measured by using the Microtrac particle size distribution measuring apparatus "UPA-150" (manufactured by NIKKISO CO., LTD.), and the volume-based median diameter was 117 nm.

Production Example 2

Preparation of Dispersion of Styrene-acrylic Resin Particles (for Core) [A1]

<<First Stage Polymerization>>

Into a reaction vessel equipped with a stirrer, a temperature sensor, a condenser, and a nitrogen introducing device, 8 parts by mass of sodium dodecyl sulfate and 3000 parts by mass of ion-exchanged water were introduced, and the internal temperature of the reaction vessel was raised to 80° C. while stirring them under a nitrogen stream. After the temperature was raised, a solution prepared by dissolving 10 parts by mass of potassium persulfate in 200 parts by mass of ion-exchanged water was added into the reaction vessel, the liquid temperature was raised to 80° C. again, a monomer mixed liquid composed of

- styrene (St) 480 parts by mass,
- n-butyl acrylate (BA) 250 parts by mass, and
- methacrylic acid (MAA) 68 parts by mass was added into the reaction vessel dropwise over 1 hour, and the mixture was heated and stirred for 2 hours at 80° C. to conduct the polymerization, thereby preparing the dispersion of resin fine particles (a1-1).

<<Second Stage Polymerization>>

Into a reaction vessel equipped with a stirrer, a temperature sensor, a condenser, and a nitrogen introducing device, a solution prepared by dissolving 7 parts by mass of sodium polyoxyethylene (2) dodecyl ether sulfate in 3000 parts by mass of ion-exchanged water was introduced and heated to 98° C., 280 parts by mass of the dispersion of resin fine particles (a1-1) and a solution prepared by dissolving a monomer (including release agent) composed of

- styrene (St) 256 parts by mass,
- n-butyl acrylate (BA) 115 parts by mass,
- methacrylic acid (MAA) 21 parts by mass,
- n-octyl mercaptan 5 parts by mass, and
- release agent (behenylbehenate (melting point: 73° C.)) 120 parts by mass at 90° C. was then added into the reaction vessel and mixed and dispersed for 1 hour by the mechanical disperser having a circulation path "CLEARMIX" (manufactured by M Technique Co., Ltd.), thereby preparing a dispersion containing emulsified particles (oil droplets).

Subsequently, an initiator solution prepared by dissolving 6 parts by mass of potassium persulfate in 200 parts by mass of ion-exchanged water was added to this dispersion, this mixture was heated and stirred for 1 hour at 84° C. to conduct the polymerization, thereby preparing the dispersion of resin fine particles (a1-2).

<<Third Stage Polymerization>>

To the dispersion of resin fine particles (a1-2), 400 parts by mass of ion-exchanged water was added and thoroughly mixed, a solution prepared by dissolving 11 parts by mass of potassium persulfate in 400 parts by mass of ion-exchanged water was then added thereto, and a monomer mixed liquid composed of

- styrene (St) 435 parts by mass,
- n-butyl acrylate (BA) 157 parts by mass,
- methacrylic acid (MAA) 41 parts by mass, and
- n-octyl mercaptan 13 parts by mass was added thereto dropwise over 1 hour at a temperature of 82° C. After the dropwise addition was completed, the resultant mixture was heated and stirred for 2 hours to conduct the polymerization, and the resultant was then cooled to 28° C., thereby preparing the dispersion of styrene-acrylic resin particles [A1]. In the dispersion of styrene-acrylic resin particles [A1], the volume-based median diameter of the resin particles was 220 nm, the glass transition temperature (Tg) thereof was 47° C., and the weight average molecular weight (Mw) thereof was 38,000.

Production Example 3

Preparation of Dispersion of Styrene-acrylic Resin Particles (for Core) [A2]

The dispersion of styrene-acrylic resin particles (for core) [A2] was prepared in the same manner as in Production Example 2 except that the composition of the monomer used in the third stage polymerization was changed as follows in Production Example 2 (Preparation of dispersion of styrene-acrylic resin particles (for core) [A1]) described above. In the dispersion of styrene-acrylic resin particles [A2], the volume-based median diameter of the resin particles was 190 nm, the glass transition temperature (Tg) thereof was 46° C., and the weight average molecular weight (Mw) thereof was 35,000.

<<Monomer Composition in the Third Stage Polymerization>>

- styrene (St) 415 parts by mass,
- styrenesulfonic acid 20 parts by mass,
- n-butyl acrylate (BA) 157 parts by mass, methacrylic acid (MAA) 41 parts by mass, and
n-octyl mercaptan 13 parts by mass.

Production Example 4

Preparation of Dispersion of Styrene-acrylic Resin Particles (for Core) [A3]

The dispersion of styrene-acrylic resin particles (for core) [A3] was prepared in the same manner as in Production Example 2 except that the composition of the monomer used in the second stage polymerization was changed as follows in Production Example 2 (Preparation of dispersion of styrene-acrylic resin particles (for core) [A1]) described above. In the dispersion of styrene-acrylic resin particles [A3], the volume-based median diameter of the resin particles was 206 nm, the glass transition temperature (Tg) thereof was 51° C., and the weight average molecular weight (Mw) thereof was 37,000.

<<Monomer Composition in the Second Stage Polymerization>> styrene (St) 275 parts by mass,
n-butyl acrylate (BA) 96 parts by mass,
methacrylic acid (MAA) 21 parts by mass,
n-octyl mercaptan 5 parts by mass, and
release agent (behenyl behenate (melting point: 73° C.)) 120 parts by mass.

Production Example 5

Preparation of Dispersion of Styrene-acrylic Resin Particles (for Shell) [A4]

Into a reaction vessel equipped with a stirrer, a temperature sensor, a condenser, and a nitrogen introducing device, 8 parts by mass of sodium dodecyl sulfate and 3000 parts by mass of ion-exchanged water were introduced, and the internal temperature of the reaction vessel was raised to 80° C. while stirring them under a nitrogen stream. After the temperature was raised, a solution prepared by dissolving 10 parts by mass of potassium persulfate in 200 parts by mass of ion-exchanged water was added into the reaction vessel, the liquid temperature was raised to 80° C. again, a monomer mixed liquid composed of styrene (St) 520 parts by mass,
n-butyl acrylate (BA) 184 parts by mass,
methacrylic acid (MAA) 94 parts by mass, and
n-octyl mercaptan 22 parts by mass was added into the reaction vessel dropwise over 3 hours, and the mixture was heated and stirred for 2 hours at 80° C. to conduct the polymerization, thereby preparing the dispersion of resin particles [A4]. In this dispersion of styrene-acrylic resin particles [A4], the volume-based median diameter of the resin particles was 85 nm, the glass transition temperature (Tg) thereof was 56° C., and the weight average molecular weight (Mw) thereof was 21,000.

Production Example 6

Preparation of Dispersion of Amorphous Polyester Resin Particles [B1]

<<Synthesis of Amorphous Polyester Resin [b1]>>

Into a reaction vessel equipped with a nitrogen inlet, a dewatering tube, a stirrer, and a thermocouple, bisphenol A propylene oxide 2 mol adduct 500 parts by mass,
terephthalic acid 117 parts by mass,
fumaric acid 82 parts by mass, and
esterified catalyst (tin octylate) 2 parts by mass were introduced, subjected to the condensation polymerization reaction for 8 hours at 230° C., and further reacted for 3 hours at 8 kPa, and the resultant was cooled to 160° C., a mixture of acrylic acid 10 parts by mass,
styrene 162 parts by mass,
n-butyl acrylate (BA) 42 parts by mass, and
polymerization initiator (di-t-butyl peroxide) 10 parts by mass was added into the reaction vessel dropwise over 1 hour using a dropping funnel. After the dropwise addition, the mixture was continuously subjected to the addition polymerization reaction for 1 hour while being kept at 160° C., the temperature thereof was then raised to 200° C., the resultant was maintained for 1 hour at 10 kPa. Acrylic acid, styrene, and butyl acrylate were then removed, thereby obtaining the amorphous polyester resin (styrene-acrylic modified polyester resin) [b1] in which the styrene-acrylic copolymer resin segment and the polyester resin segment were bonded each other. The glass transition temperature (Tg) of the amorphous polyester resin [b1] thus obtained was 50° C. and the weight average molecular weight (Mw) thereof was 22,000.

<<Preparation of Dispersion of Amorphous Polyester Resin Particles [B1]>>

In 400 parts by mass of ethyl acetate, 100 parts by mass of the amorphous polyester resin [b1] thus obtained was dissolved.

Subsequently, 25 parts by mass of a 5.0% by mass aqueous solution of sodium hydroxide was added to the solution to prepare a resin solution. This resin solution was introduced into a vessel having a stirring device, 638 parts by mass of 0.26% by mass aqueous solution of sodium lauryl sulfate was added to the resin solution dropwise over 30 minutes while stirring the resin solution so as to be mixed. The liquid in the reaction vessel was clouded in the middle of dropwise addition of the aqueous solution of sodium lauryl sulfate, and further, an emulsion in which resin solution particles were uniformly dispersed was formed after the rest of the total amount of the aqueous solution of sodium lauryl sulfate was added dropwise.

Subsequently, the emulsion was heated to 40° C., and ethyl acetate was distilled off under reduced pressure of 150 hPa by using the diaphragm type vacuum pump "V-700" (manufactured by BUCHI Labortechnik AG), thereby obtaining the "dispersion of amorphous polyester resin particles [B1]".

Production Example 7

Preparation of Release Agent Dispersion [W1]

In 72 parts by mass of methyl ethyl ketone, 72 parts by mass of a release agent (behenyl behenate) was dissolved by stirring for 30 minutes at 78° C. Next, this solution was introduced into a reaction vessel having a stirrer, mixed with 252 parts by mass of water warmed at 78° C. while stirring, and subjected to the ultrasonic dispersion for 30 minutes at V-LEVEL and 300 μA by using the ultrasonic homogenizer "US-150T" (manufactured by Nippon Seiki Co., Ltd.) while stirring, thereby obtaining an emulsion.

Subsequently, this emulsion was warmed at 70° C. and stirred for 3 hours under reduced pressure of 15 kPa (150 mbar) to distill off methyl ethyl ketone by using the diaphragm type vacuum pump "V-700" (manufactured by BUCHI Labortechnik AG), thereby preparing the aqueous dispersion [W1] in which a release agent (behenyl behenate) was dispersed. The particle size of the particles contained in the dispersion was measured by the laser diffraction particle size distribution measuring apparatus "LA-750" (manufactured by HORIBA, Ltd.), and as a result, the volume average particle size was 170 nm.

[Production of Toner 1]

<<Preparation (Aggregation and Fusion Step) of Dispersion of Toner Base Particles 1>>

Into a reaction vessel equipped with a stirrer, a temperature sensor, and a condenser, 324 parts by mass (in terms of solid content) of the "dispersion of styrene-acrylic resin particles [A1]" prepared in Production Example 2 and 2,000 parts by mass of ion-exchanged water were introduced, a 5 mol/liter aqueous solution of sodium hydroxide was added into the reaction vessel to adjust the pH thereof at 25° C. to 10. Thereafter, 40 parts by mass (in terms of solid content) of the "dispersion of colorant particles" prepared in Production Example 1 was added into the reaction vessel.

Subsequently, 15 parts by mass (in terms of solid content) of an aqueous solution of aluminum sulfate (solid content concentration: 0.3% bymass) was added into the reaction vessel dropwise over 10 minutes to initiate the aggregation.

Thereafter, the mixture was left to stand for 3 minutes, the temperature raising was then started, the temperature of this mixture was raised to 75° C. over 60 minutes, and the particle growth reaction was continuously conducted while keeping the mixture at 75° C. The particle size of the associated particles was measured by the "COULTER Multisizer 3" (manufactured by Beckman Coulter, Inc.) in this state, 36 parts by mass (in terms of solid content) of the "dispersion of styrene-acrylic resin particles [A4]" was introduced into the mixture over 30 minutes as the dispersion of resin particles for shell at the time when the volume-based median diameter ($D_{50}$) reached 6.0 μm, and an aqueous solution prepared by dissolving 80 parts by mass of sodium chloride in 320 parts by mass of ion-exchanged water was added to the mixture to terminate the particle growth at the time when the supernatant of the reaction mixture became clear.

Furthermore, the mixture was subjected to the temperature raising, heated and stirred in a state of being at 85° C. to advance fusion of the particles, and cooled to 30° C. at the time when the average circularity reached 0. 945, thereby preparing the "dispersion of toner base particles 1". Incidentally, the average circularity of the toner base particles was measured (HPF detection number was 4000) by using the measuring apparatus the "FPIA-2100" (manufactured by Sysmex Corporation). In addition, the particle size of the toner base particles (associated particles) obtained in the above was measured, and the volume-based median diameter was 6.1 μm. Incidentally, the median diameter was measured by using the "COULTER Multisizer 3" (manufactured by Beckman Coulter, Inc.).

<<Cleaning Step and Drying Step>>

The dispersion of toner base particles 1 thus obtained was subjected to the solid-liquid separation by a centrifuge, and a wet cake of the toner base particles was formed. The wet cake was cleaned using the centrifuge with ion-exchanged water at 35° C. until the electric conductivity of the filtrate reached 5 μS/cm. Thereafter, the wet cake was moved to the "flash jet dryer" (manufactured by SEISHIN ENTERPRISE Co., Ltd.) and dried until the water content therein reached 0.5% by mass, thereby preparing the "toner base particles 1".

<<Step of Treating with External Additive>>

To the toner base particles 1, 1.3% by mass of mixed hydrophobic silica (composed of those having a number average primary particle size of 12 nm at 1% by mass and those having a number average primary particle size of 80 nm at 0.3% by mass) and 0.3% by mass of hydrophobic titania (those having number average primary particle size of 20 nm) were added and mixed by the Henschel mixer, thereby producing the "toner 1". Incidentally, the number average primary particle size of the respective external additives was determined by the method described above.

Incidentally, the content (content ratio) of the constitutional unit derived from a monomer having an acid group relative to the total amount of the constitutional units constituting the vinyl resin in the vinyl resin contained in the toner base particles 1 is presented in Table 1 (item of "monomer having an acid group/vinyl resin"). The value is calculated from the mass ratio of the monomer used as the raw material, and it has been confirmed to be consistent with the value by NMR measurement.

[Production of Toners 2 to 9 and 11 to 15]

The toners 2 to 9 and 11 to 15 were respectively produced in the same manner as the above except that the dispersions of resin particles for core and shell and the kind and addition amount of the aggregating agent were changed as presented in Table 1 in the "Production of toner 1". Incidentally, the concentrations of the aqueous solution of magnesium chloride and the aqueous solution of calcium chloride which were used as the aggregating agent in the toners 2 and 13 to 15 were 50% by mass, respectively.

[Production of Toner 10]

The toner 10 was produced in the same manner as the above except that the dispersion of resin particles for shell (dispersion of styrene-acrylic resin particles [A4]) was not used and the dispersion of resin particles for core was changed as presented in Table 1 in the "Production of toner 1".

[Production of Toner 16]

The toner 16 was produced in the same manner as the above except that the dispersion of resin particles for shell (dispersion of styrene-acrylic resin particles [A4]) was not used, the dispersion of resin particles for core was changed as presented in Table 1, and the release agent dispersion [W1] was used at the same timing as the dispersion of resin particles for core in the "Production of toner 1".

Incidentally, the content (content ratio) of the constitutional unit derived from a monomer having an acid group relative to the total amount of the constitutional units constituting the vinyl resin in the vinyl resin contained in the toner base particles is presented in Table 1 (item of "monomer having an acid group/vinyl resin") for the toners 2 to 15 as well in the same manner as the toner 1.

TABLE 1

| | Core particles | | Shell layer | | | Release agent | | Aggregating agent | |
|---|---|---|---|---|---|---|---|---|---|
| | Resin particle dispersion | Parts by mass (solid content) | Resin particle dispersion | Parts by mass (solid content) | Monomer having acid group/vinyl resin (% by mass) | Dispersion | Parts by mass (solid content) | Kind | Parts by mass (solid content) |
| Toner 1 | Styrene-acrylic [A1] | 324 | Styrene-acrylic [A4] | 36 | 6.7 | — | — | Aluminum sulfate | 15 |
| Toner 2 | Styrene-acrylic [A1] | 324 | Styrene-acrylic [A4] | 36 | 6.7 | — | — | Aluminum sulfate<br>Magnesium chloride | 15<br>10 |
| Toner 3 | Styrene-acrylic [A1] | 324 | Styrene-acrylic [A4] | 36 | 6.7 | — | — | Aluminum sulfate | 17 |
| Toner 4 | Styrene-acrylic [A1] | 324 | Styrene-acrylic [A4] | 36 | 6.7 | — | — | Aluminum sulfate | 20 |
| Toner 5 | Styrene-acrylic [A1] | 324 | Styrene-acrylic [A4] | 36 | 6.7 | — | — | Aluminum sulfate | 13 |
| Toner 6 | Styrene-acrylic [A1] | 324 | Styrene-acrylic [A4] | 36 | 6.7 | — | — | Aluminum sulfate | 10 |
| Toner 7 | Styrene-acrylic [A1] | 324 | Polyester [B1] | 36 | 6.2 | — | — | Aluminum sulfate | 15 |
| Toner 8 | Styrene-acrylic [A1] | 252 | Polyester [B1] | 108 | 6.2 | — | — | Aluminum sulfate | 15 |
| Toner 9 | Styrene-acrylic [A2] | 324 | Styrene-acrylic [A4] | 36 | 8.4 | — | — | Aluminum sulfate | 15 |
| Toner 10 | Styrene-acrylic [A3] | 360 | — | — | 6.2 | — | — | Aluminum sulfate | 15 |
| Toner 11 | Styrene-acrylic [A1] | 324 | Styrene-acrylic [A4] | 36 | 6.7 | — | — | Aluminum sulfate | 5 |
| Toner 12 | Styrene-acrylic [A1] | 324 | Styrene-acrylic [A4] | 36 | 6.7 | — | — | Aluminum sulfate | 30 |
| Toner 13 | Styrene-acrylic [A1] | 324 | Styrene-acrylic [A4] | 36 | 6.7 | — | — | Magnesium chloride | 30 |
| Toner 14 | Styrene-acrylic [A1] | 324 | Styrene-acrylic [A4] | 36 | 6.7 | — | — | Magnesium chloride | 40 |
| Toner 15 | Styrene-acrylic [A1] | 324 | Styrene-acrylic [A4] | 36 | 6.7 | — | — | Calcium chloride | 30 |
| Toner 16 | Polyester [B1] | 324 | — | — | — | Release agent [W1] | 36 | Aluminum sulfate | 15 |

<Analysis>

The amount (content) of the metal element present in the toner base particles was measured by the following method (acid decomposition: inductively coupled plasma emission spectral analysis).

(Pretreatment)

To 35 parts by mass of a 0.2% by mass aqueous solution of polyoxyethylene phenyl ether, 3 parts by mass of the toner (1) thus obtained was added, dispersed therein, and treated by the ultrasonic homogenizer (US-1200T manufactured by Nippon Seiki Co., Ltd.) for 5 minutes at 25° C. to remove the external additive from the toner surface, thereby obtaining toner base particles for the measurement of the content of metal element.

By the closed type microwave digestion apparatus "ETHOS 1 manufactured by Milestone General K. K.", 100 mg of the toner base particles was decomposed with sulfuric acid and nitric acid. At this time, the target component was eluted by using hydrochloric acid, hydrofluoric acid, hydrogen peroxide, and the like in a case in which there was an undecomposed substance. The decomposition solution was appropriately diluted with ultrapure water. In the above, the reagents used were the ultrahigh-purity reagents manufactured by KANTO CHEMICAL CO., INC.

(Measurement)

A radio inductively coupled plasma emission analyzer (ICP-OES, manufactured by SII Nano Technology Inc., SPS3520UV) was used. At this time, the detection wavelengths of the respective metal elements were as follows:

Al 167.079 nm;

Mg 279.553 nm;

Fe 259.940 nm; and

Ca 393.477 nm.

Incidentally, the calibration curve was obtained by using a solution prepared by adding the atomic absorption standard solution for each element manufactured by KANTO CHEMICAL CO., INC. to a decomposition solution which did not contain the sample and adjusting the acid concentration to be the same as that in the sample solution.

The measurement results of the content (unit: ppm by mass) of the respective metal elements in the toner base particles are presented in the following Table 2. Incidentally, the contents of Al, Mg, Fe, and Ca were measured as the measurement of metal element. In Table 2, only the detected metal element was presented and those that are not detected among the above metal elements are not presented.

<Evaluation>

[Low Temperature Fixability]

The developers containing the toners according to Examples or Comparative Examples were filled in the copying machine "bizhub PRO (registered trademark) C6501" (manufactured by Konica Minolta, Inc.) of which the fixing device had been modified so that the surface temperature of the heat roller for fixing was able to be changed in a range of from 100 to 210° C. The fixing experiment to fix a solid image having a toner deposition amount of 11 g/m$^2$ on A4-size plain paper (basis weight: 80 g/m$^2$) was repeatedly conducted while changing the fixing temperature to be set from 85° C. to 130° C. so as to increase by 5° C.

Subsequently, the printed papers obtained in the fixing experiment for each fixing temperature was folded so as to apply a load to the solid image by a folding machine, the compressed air at 0.35 MPa was blown to this, the crease was ranked in 5 stages according to the following rank criteria. The fixing temperature in the fixing experiment which exhibited the lowest fixing temperature among the fixing experiments ranked to 3 was adopted as the lower limit fixing temperature. The evaluation results are presented in the following Table 2.

<Rank Criteria of Crease>

Rank 5: entirely no crease

Rank 4: partly peeled off along crease

Rank 3: peeled off in fine lines along crease

Rank 2: peeled off in thick lines along crease

Rank 1: greatly peeled off (Evaluation Criteria of Fixing Temperature)

⊙: fixing temperature of 105° C. or lower

○: fixing temperature of higher than 105° C. or and 118° C. or lower

Δ: fixing temperature of higher than 118° C. or and 120° C. or lower

X: fixing temperature of higher than 120° C.

Incidentally, it means that the low temperature fixability is superior as the lower limit fixing temperature is lower. When the lower limit fixing temperature was 120° C. or lower, it is judged that the toner is acceptable since there is no practical problem.

[Difference in Electrification by Environment]

Into a 20mL glass container, 19 g of a ferrite carrier which was covered with an acrylic resin and had a volume average particle size of 30 μm and 1 g of the toner were introduced, subjected to the humidity conditioning for 12 hours in a low-temperature and low-humidity environment (10° C., 20% RH) and a high-temperature and high-humidity environment (30° C., 80%), respectively, and shaken 200 times per minute for 20 minutes at a swing angle of 45 degrees and an arm of 50 cm in the respective environments, and the electric charge amount thereof was then measured by using the measuring apparatus illustrated in Figure.

For the measurement, the charge amount and mass of the toner supplied to the developing region were measured when 50 mg of the two-component developer 46 was disposed in between the parallel plate (aluminum) electrodes 36 and 37 while being slid, and the toner was developed at an inter-electrode gap of 0.5 mm, a DC bias of 1.0 kV, an AC bias of 4. 0 kV under the conditions of 2.0 kHz, and thus, the charge amount Q/m (μC/g) per unit mass was determined, and the value was adopted as the electric charge amount. The evaluation results are presented in the following Table 2.

(Evaluation Criteria)

The evaluation was ranked as follows by the difference between the electric charge amount in the low-temperature and low-humidity environment and the electric charge amount in the high-temperature and high-humidity environment;

⊙: less than 10 μC/g (excellent)

○: 10 μC/g or more and less than 15 μC/g (favorable)

Δ: 15 μC/g or more and less than 20 μC/g (practically acceptable)

X: 20 μC/g or more (practically unacceptable).

Incidentally, it means that the environmental stability of electrification is superior as the difference in electric charge amount is smaller, and it is judged that the toner is acceptable when the difference in electric charge amount is less than 20 μC/g.

[Evaluation on Gloss (Quality of Coated Paper)]

The developers containing the toners according to Examples or Comparative Examples were filled in the copying machine "bizhub PRO (registered trademark) C6501" (manufactured by Konica Minolta, Inc.) of which the fixing device had been modified so that the surface temperature of the heat roller for fixing was able to be changed in a range of from 100 to 210° C. The fixing experiment to fix a solid image having a toner deposition amount of 8.0 g/m$^2$ on A4-size coated paper of "POD80 gloss coated (80 g/m$^2$)" (manufactured by OJI PAPER CO., LTD.) was repeatedly conducted while changing the fixing temperature to be set from 100° C. to 180° C. so as to increase by 10° C., and the gloss level of the solid image was measured. The evaluation results are presented in the following Table 2.

Incidentally, the gloss level was measured at an incident angle of 75° by using the "Gloss Meter" (manufactured by MURAKAMI COLOR RESEARCH LABORATORY CO., Ltd.) and the glass surface having a refractive index of 1.567 as a reference.

(Evaluation Criteria)

○: highest gloss level of 70% or more

Δ: highest gloss level of 60% or more and less than 70%

X: highest gloss level of less than 60%.

Incidentally, it means that the glossiness is superior as the gloss level is higher, and it is judged that the toner is acceptable when the highest gloss level is 60% or more since there is no practical problem.

[Image Density (Quality on Rough Paper)]

A solid image was formed on rough paper (trade name "Hammermill tidal" manufactured by International Paper Company) by using a copying machine at the surface temperature of the heat roller for fixing of 170° C. so as to have a toner deposition amount of 4.0 g/m$^2$, and the image density was evaluated by the relative reflection density by using the reflection densitometer "RD-918" (manufactured by X-Rite Inc.) and the density of blank paper as a reference. The evaluation results are presented in the following Table 2.

(Evaluation Criteria)

○: reflection density of 1.4 or more

Δ: reflection density of 1.25 or more and less than 1.4

X: reflection density of less than 1.25.

Incidentally, it means that the image density is superior as the reflection density is higher, and it is judged that the toner is acceptable when the reflection density is 1.25 or more since there is no practical problem.

TABLE 2

| | | Constitution of toner | | | | Evaluation results | | | |
|---|---|---|---|---|---|---|---|---|---|
| | | Constitution of resin | | Metal element in toner base particles | | | | | |
| | | Styrene-acrylic (% by mass) | Polyester (% by mass) | Kind | Contained concentration (ppm by mass) | Lower limit fixing temperature (° C.) | Difference in electrostatic charge by environment (μC/g) | Quality of coated paper Highest gloss level (%) | Quality of rough paper Density |
| Example 1 | Toner 1 | 100 | 0 | Aluminum | 1480 | 109(○) | 12(○) | 73(○) | 1.46(○) |
| Example 2 | Toner 2 | 100 | 0 | Aluminum<br>Magnesium | 1420<br>430 | 109(○) | 12(○) | 73(○) | 1.48(○) |
| Example 3 | Toner 3 | 100 | 0 | Aluminum | 1600 | 111(○) | 13(○) | 72(○) | 1.48(○) |
| Example 4 | Toner 4 | 100 | 0 | Aluminum | 2040 | 119(Δ) | 18(Δ) | 71(○) | 1.50(○) |
| Example 5 | Toner 5 | 100 | 0 | Aluminum | 1290 | 108(○) | 11(○) | 74(○) | 1.43(○) |
| Example 6 | Toner 6 | 100 | 0 | Aluminum | 960 | 107(○) | 9(⊙) | 67(Δ) | 1.34(Δ) |
| Example 7 | Toner 7 | 90 | 10 | Aluminum | 1520 | 104(⊙) | 14(○) | 68(Δ) | 1.37(Δ) |
| Example 8 | Toner 8 | 70 | 30 | Aluminum | 1410 | 101(⊙) | 19(Δ) | 64(Δ) | 1.30(Δ) |
| Example 9 | Toner 9 | 100 | 0 | Aluminum | 1890 | 111(○) | 18(Δ) | 72(○) | 1.47(○) |
| Example 10 | Toner 10 | 100 | 0 | Aluminum | 1460 | 120(Δ) | 12(○) | 71(○) | 1.47(○) |
| Comparative Example 1 | Toner 11 | 100 | 0 | Aluminum | 760 | 105(⊙) | 8(⊙) | 58(X) | 1.22(X) |
| Comparative Example 2 | Toner 12 | 100 | 0 | Aluminum | 2400 | 125(X) | 24(X) | 70(○) | 1.49(○) |
| Comparative Example 3 | Toner 13 | 100 | 0 | Magnesium (*1) | 1430 | 105(⊙) | 11(○) | 55(X) | 1.18(X) |
| Comparative Example 4 | Toner 14 | 100 | 0 | Magnesium (*1) | 3320 | 113(○) | 28(X) | 62(Δ) | 1.38(Δ) |
| Comparative Example 5 | Toner 15 | 100 | 0 | Calcium (*1) | 1510 | 106(○) | 12(○) | 56(X) | 1.21(X) |
| Comparative Example 6 | Toner 16 | 0 | 100 | Aluminum | 1750 | 98(⊙) | 25(X) | 61(Δ) | 1.27(Δ) |

*1: Aluminum was below the detection limit.

From the results in Table 2, the toner according to the present invention exhibits low environmental dependency of electric charge amount while maintaining low temperature fixability, and the glossiness and density of the image to be formed are favorable. Among them, the toners 1, 3, and 5 have favorable results for all the evaluation items, and thus it is believed that the toner including the toner base particles having a core-shell structure and a concentration of aluminum contained of from 1,200 to 1,800 ppm by mass particularly have an excellent balance among the respective properties described above. In addition, the toner 2 contains a divalent metal (magnesium) in addition to aluminum but has favorable results for the respective physical properties such as the environmental dependency of electric charge amount. This fact indicates that the effect of the present invention is obtained even though the toner base particles contain a divalent metal such as magnesium.

In contrast, the glossiness or density of the image to be formed is not sufficient in the case of the toner 11 in which the concentration of aluminum contained is lower than the lower limit (900 ppm) of the present invention. In addition, the low temperature fixability and the environmental dependency of electric charge amount are inferior in the case of the toner 12 in which the concentration of aluminum contained is higher than the upper limit (2,200 ppm) of the present invention.

In addition, the concentration of metal element is approximately equal in the toners 1, 13, and 15, but it is indicated that the glossiness and density of the image to be formed are not sufficient in the case of the toners 13 and 15 in which the included metal element is magnesium or calcium.

What is claimed is:

1. A toner for electrostatic charge image development, comprising toner base particles containing a binder resin containing as a main component a vinyl resin having a constitutional unit derived from a monomer having a carboxylic acid group, and aluminum, wherein a concentration of the aluminum in the toner base particles, as measured by radio inductively coupled plasma emission spectral analysis, is from 900 to 2,200 ppm, and a content of the constitutional unit derived from the monomer having the carboxylic acid group is from 3 to 20% by mass, relative to the total constitutional units of the vinyl resin.

2. The toner for electrostatic charge image development according to claim 1, wherein the monomer having the carboxylic acid group is (meth)acrylic acid.

3. The toner for electrostatic charge image development according to claim 1, wherein the concentration of the aluminum is from 1,200 to 1,800 ppm.

4. The toner for electrostatic charge image development according to claim 1, wherein the toner base particles further comprise at least one selected from the group consisting or magnesium, iron, and calcium.

5. The toner for electrostatic charge image development according to claim 1, wherein the toner base particles have a core-shell structure.

6. The toner for electrostatic charge image development according to claim 1, further comprising silica particles having a number average primary particle size of from 60 to 150 nm as an external additive.

7. The toner for electrostatic charge image development according to claim 1, wherein the content of the constitutional unit derived from the monomer having the carboxylic acid group is from 5 to 15% by mass, relative to the total constitutional units of the vinyl resin.

* * * * *